US010875695B2

(12) United States Patent
Okude et al.

(10) Patent No.: US 10,875,695 B2
(45) Date of Patent: Dec. 29, 2020

(54) REFILLABLE CONTAINER

(71) Applicant: NIPPON PAPER INDUSTRIES CO., LTD., Tokyo (JP)

(72) Inventors: Hideki Okude, Tokyo (JP); Takaharu Noda, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 28 days.

(21) Appl. No.: 16/335,879

(22) PCT Filed: Sep. 25, 2017

(86) PCT No.: PCT/JP2017/034446

§ 371 (c)(1),
(2) Date: Mar. 22, 2019

(87) PCT Pub. No.: WO2018/062066

PCT Pub. Date: Apr. 5, 2018

(65) Prior Publication Data

US 2020/0017272 A1 Jan. 16, 2020

(30) Foreign Application Priority Data

Sep. 30, 2016 (JP) ..... 2016194482
Sep. 22, 2017 (JP) ..... 2017182075

(51) Int. Cl.
*B65D 77/04* (2006.01)
*B65D 5/40* (2006.01)
(Continued)

(52) U.S. Cl.
CPC ..... *B65D 77/0453* (2013.01); *B65D 5/40* (2013.01); *B65D 25/20* (2013.01); *B65D 83/00* (2013.01)

(58) Field of Classification Search
CPC .. B65D 77/0453; B65D 77/0446; B65D 5/40; B65D 25/20; B65D 83/00
(Continued)

(56) References Cited

U.S. PATENT DOCUMENTS

2011/0073596 A1* 3/2011 Chang ..... B65D 83/0005 220/23.87

FOREIGN PATENT DOCUMENTS

JP 60-127987 8/1985
JP 2-23381 2/1990
(Continued)

OTHER PUBLICATIONS

International Search Report dated Nov. 7, 2017 in International (PCT) Application No. PCT/JP2017/034446.

*Primary Examiner* — Robert J Hicks
(74) *Attorney, Agent, or Firm* — Wenderoth, Lind & Ponack, L.L.P.

(57) ABSTRACT

A refillable container includes: an inner container (5); an accommodation member (7) configured to accommodate the inner container; a lid member configured to close the accommodation member; a taking-out part (9) configured to take out the content contained in the inner container accommodated in the accommodation member; and an inner-container restraint part (59), which is provided between the lid member and the inner container, is configured to restrain the lid member and the inner container so as to prevent the inner container from falling from an opening portion of the lid member, when the lid member is removed from the accommodation member. Also, the inner-container restraint part is configured to release the restraint between the lid member and the inner container when the inner container in which the content has been exhausted is pulled from the opening portion of the lid member in a pull-out direction.

10 Claims, 29 Drawing Sheets

(51) Int. Cl.
*B65D 25/20* (2006.01)
*B65D 83/00* (2006.01)

(58) Field of Classification Search
USPC ..... 220/23.88, 23.87, 528; 206/577, 223; 215/6
See application file for complete search history.

(56) References Cited

FOREIGN PATENT DOCUMENTS

| | | |
|---|---|---|
| JP | H05-81051 U | 11/1993 |
| JP | 3033204 | 1/1997 |
| JP | 2003-252338 | 9/2003 |
| JP | 2007-15743 | 1/2007 |

* cited by examiner

REFILLABLE CONTAINER

TECHNICAL FIELD

The present invention relates to a refillable container which can be refilled with a liquid content such as cosmetics and detergents.

BACKGROUND ART

As a refillable container which can be refilled with a liquid content such as cosmetics and detergents, there has hitherto been known a refillable container including: an inner container configured to contain a content and be replaced when the content has been exhausted; an accommodation member, which has an accommodation opening, and is configured to accommodate the inner container; a cylindrical lid member fitted to the accommodation member accommodating the inner container to close the accommodation member; and a taking-out part configured to take out the content contained in the inner container accommodated in the accommodation member (see, for example, Patent Literatures 1 and 2).

Refilling is performed with the refillable containers described in Patent Literatures 1 and 2 in the following manner. When the content has been exhausted, the lid member is removed from the accommodation member, and the inner container is taken out from the accommodation member. Then, the inner container is replaced with a new inner container.

In general, in many cases, an inner container configured to contain a content is formed into a shape having a size which is suitable to be accommodated in an accommodation member in a state in which a gap with the accommodation member is small so as to prevent the accommodation member from becoming larger more than necessary. Therefore, it is troublesome to perform an operation of taking out the inner container in which a liquid content has been exhausted from the accommodation member.

According to the refillable container described in Patent Literature 1, a container main body serving as an inner container has a neck portion, and the neck portion has a mouth portion. Thus, the inner container can be easily taken out from the accommodation member by holding the neck portion. Further, according to the refillable container described in Patent Literature 2, a mouth plug is mounted so as to protrude on a flat upper surface of an inner container. Thus, the inner container can be easily taken out from an accommodation member by holding the mouth plug.

CITATION LIST

Patent Literature

[PTL 1] JP 2003-252338 A
[PTL 2] JP H05-81051 U

SUMMARY OF INVENTION

Technical Problem

The inner container can be easily taken out from the accommodation member by holding the neck portion formed in the inner container with the refillable container described in Patent Literature 1, or by holding and pulling up the mouth plug mounted to the flat upper surface of the inner container with the refillable container as described in Patent Literature 2. However, the neck portion formed in the inner container or the mouth plug mounted to the flat upper surface of the inner container creates a needless space in the accommodation member configured to accommodate the inner container. Therefore, there arises a problem in that the accommodation member becomes larger more than necessary.

Further, there arises a problem in that the neck portion formed in the inner container or the mouth plug mounted to the flat upper surface of the inner container causes an increase in manufacturing cost of the inner container.

An object of the present invention is to provide a refillable container which allows an inner container to be easily taken out from an accommodation member so as to enable an operation of refilling a content through replacement of the inner container to be easily performed, and which enables reduction in size of the accommodation member configured to accommodate the inner container.

Solution to Problem

In order to achieve the above-mentioned objects, according to a first aspect of the invention, there is provided a refillable container including: an inner container configured to contain a content and be replaced when the content has been exhausted; an accommodation member, which has an accommodation opening, and is configured to accommodate the inner container; a cylindrical lid member, which is to be fitted to the accommodation member accommodating the inner container, and is configured to close the accommodation member; a taking-out part configured to take out the content contained in the inner container accommodated in the accommodation member; and an inner-container restraint part, which is provided between the lid member and the inner container, is configured to restrain the lid member and the inner container so as to prevent the inner container from falling from an opening portion of the lid member by its own weight when the lid member is removed from the accommodation member, and is configured to release the restraint between the lid member and the inner container when the inner container in which the content has been exhausted is pulled from the opening portion of the lid member in a pull-out direction.

According to the first aspect of the invention, when the lid member is removed from the accommodation member accommodating the inner container, the inner container accommodated in the lid member is taken out from the accommodation member integrally with the lid member through intermediation of the inner-container restraint part. Accordingly, even when the opening portion of the lid member is oriented downward, the inner container is prevented from falling from the lid member. Then, the inner container in which the content has been exhausted can be reliably pulled out from the opening portion of the lid member.

According to a second aspect of the invention, in the first aspect of the invention, the inner-container restraint part includes: a protruding step portion provided on an upper outer surface of a body of the inner container; and a protruding portion provided on an inner surface of a cylindrical wall portion which is fitted to an outer periphery of the accommodation member of the lid member. At a time of an operation of closing the accommodation member by the lid member, the protruding portion rides over the protruding step portion provided on the upper outer surface of the inner container accommodated in the accommodation member. At a time of an operation of removing the lid member from the accommodation member, the protruding portion engages with a lower side of the protruding step portion so as to restrain the inner container and prevent the inner container from falling from the opening portion of the lid member by its own weight, and the restraint is released by pulling the inner container from the opening portion of the lid member so that the protruding step portion rides over the protruding portion.

According to the second aspect of the invention, at the time of the operation of removing the lid member from the accommodation member, the protruding portion provided on the inner surface of the cylindrical wall portion of the lid member engages with the lower side of the protruding step portion provided on the inner container accommodated in the accommodation member, and the inner container is taken out from inside the accommodation member integrally with the lid member, and the inner container is prevented from falling from the lid member even when the opening portion of the lid member is oriented downward.

Then, when the inner container in which the content has been exhausted is pulled from the opening portion of the lid member, the protruding step portion rides over the protruding portion, and hence the inner container can be reliably pulled out from the opening portion of the lid member.

According to a third aspect of the invention, in the second aspect of the invention, the protruding step portion provided on the upper outer surface of the body of the inner container is provided at an upper end edge portion of the body.

According to the third aspect of the invention, at the time of the operation of removing the lid member from the accommodation member, the protruding portion provided on the inner surface of the cylindrical wall portion of the lid member engages with the lower side of the protruding step portion provided on the upper end edge of the body of the inner container accommodated in the accommodation member so that the inner container is taken out from the accommodation member integrally with the lid member.

According to a fourth aspect of the invention, in the second aspect of the invention, the protruding step portion provided on the upper outer surface of the body of the inner container is provided on an outer peripheral surface of the body.

According to the fourth aspect of the invention, at the time of the operation of removing the lid member from the accommodation member, the protruding portion provided on the inner surface of the cylindrical wall portion of the lid member engages with the lower side of the protruding step portion provided on the outer peripheral surface of the body of the inner container accommodated in the accommodation member so that the inner container is taken out from the accommodation member integrally with the lid member.

According to a fifth aspect of the invention, in the first aspect of the invention, the inner-container restraint part is provided on one or both of an inner surface of a cylindrical wall portion of the lid member and an outer surface of a body of the inner container, and is formed of a contact portion configured to make the inner surface of the cylindrical wall portion of the lid member come into contact with the outer surface of the body of the inner container. In a case in which a resistance force of the contact portion at a time of pulling out the inner container from an opening portion of the lid member is represented by X1, a lower limit resistance force to prevent the inner content from falling from the opening portion of the lid member by its own weight is represented by X2, and an upper limit resistance force capable of pulling out the inner container accommodated in the lid member from the opening portion of the lid member in a state in which the content has been exhausted is represented by X3, the resistance force X1 given at the time of pulling out the inner container accommodated in the lid member from the opening portion of the lid member is set within a range defined by $X2 \leq X1 \leq X3$.

According to the fifth aspect of the invention, $X2 \leq X1 \leq X3$ is set, and hence, when the lid member is removed from the accommodation member accommodating the inner container, the inner container accommodated in the lid member is taken out from the accommodation member integrally with the lid member, and even when the opening portion of the lid member is oriented downward, the inner container is prevented from falling from the lid member. Then, the inner container in which the content has been exhausted can be pulled out reliably from the opening portion of the lid member.

According to a sixth aspect of the invention, in the fifth aspect of the invention, the lower limit resistance force X2 is calculated with the inner container in a state in which the content has been exhausted.

According to the sixth aspect of the invention, the lower limit resistance force X2 is calculated with the inner container in a state in which the content has been exhausted, and hence, when the lid is removed from the accommodation member after the content has been exhausted, the inner container is prevented from falling from inside the lid member by its own weight, and the inner container accommodated in the lid member is reliably taken out from the accommodation member integrally with the lid member.

According to a seventh aspect of the invention, in the fifth aspect of the invention, the lower limit resistance force X2 is calculated with the inner container in a state in which the content is fully contained.

According to the seventh aspect of the invention, the lower limit resistance force X2 is calculated with the inner container in a state in which the content is fully contained, and hence, when the lid member is removed from the accommodation member in the state in which the content is fully contained in the inner container, the inner container is prevented from falling from inside the lid member by its own weight, and the inner container accommodated in the lid member can be taken out reliably from the accommodation member integrally with the lid member.

According to an eighth aspect of the invention, in any one of the fifth through seventh aspects of the invention, the upper limit resistance force X3 is calculated as a resistance force capable of pulling out the inner container from the opening portion of the lid member without difficulty in a state in which the content contained in the inner container accommodated in the lid member has been exhausted.

According to the eighth aspect of the invention, the upper limit resistance force X3 is calculated as a resistance force capable of pulling out the inner container from the opening portion of the lid member without difficulty in the state in which the content contained in the inner container accommodated in the lid member has been exhausted, and hence the inner container in which the content has been exhausted can be easily and reliably pulled out from the opening portion of the lid member.

Advantageous Effects of Invention

According to the refillable container of the present invention, when the lid member is removed from the accommodation member in the operation of refilling in which an inner container is replaced by a new inner container, the inner container accommodated in the accommodation member can be taken out from the accommodation member integrally with the lid member, and the inner container in which a content has been exhausted can be pulled out from an opening of the lid member. Accordingly, the operation of refilling the content through replacement of the inner container can be easily performed.

Further, the inner container is not required to have a protruding portion such as a mouth plug also serving as a holding portion at the time of taking out from the accommodation member on the upper surface, and thereby a needless space in the accommodation member accommodating the inner container is eliminated and the accommodation member can be reduced in size by the amount corresponding to the needless space.

DESCRIPTION OF EMBODIMENTS

Now, examples of a refillable container according to an embodiment of the present invention is described in detail with reference to the drawings.

Figure 1:
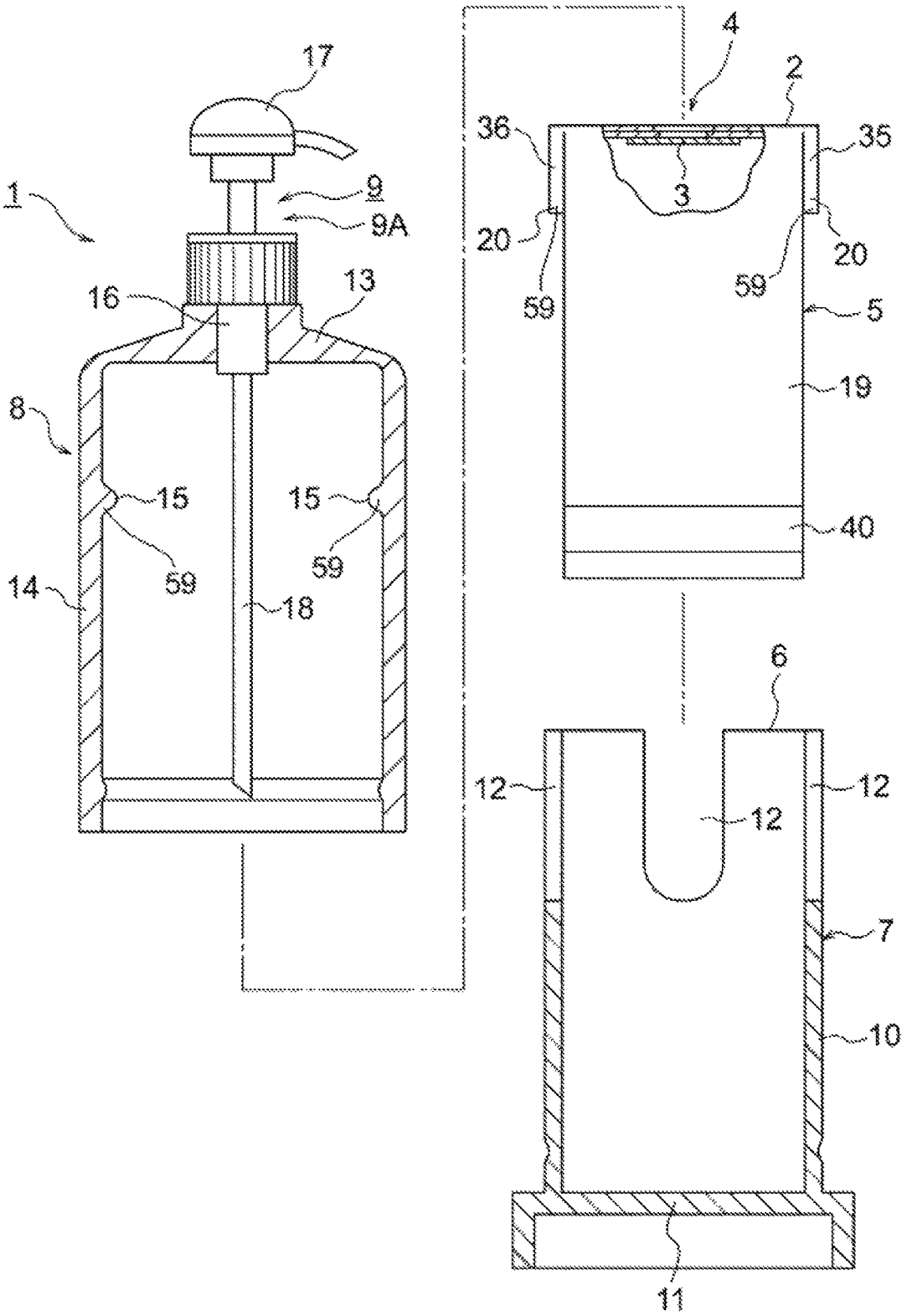
FIG. 1 is an exploded sectional view for illustrating a first example of a refillable container according to an embodiment of the present invention.
Figure 2:
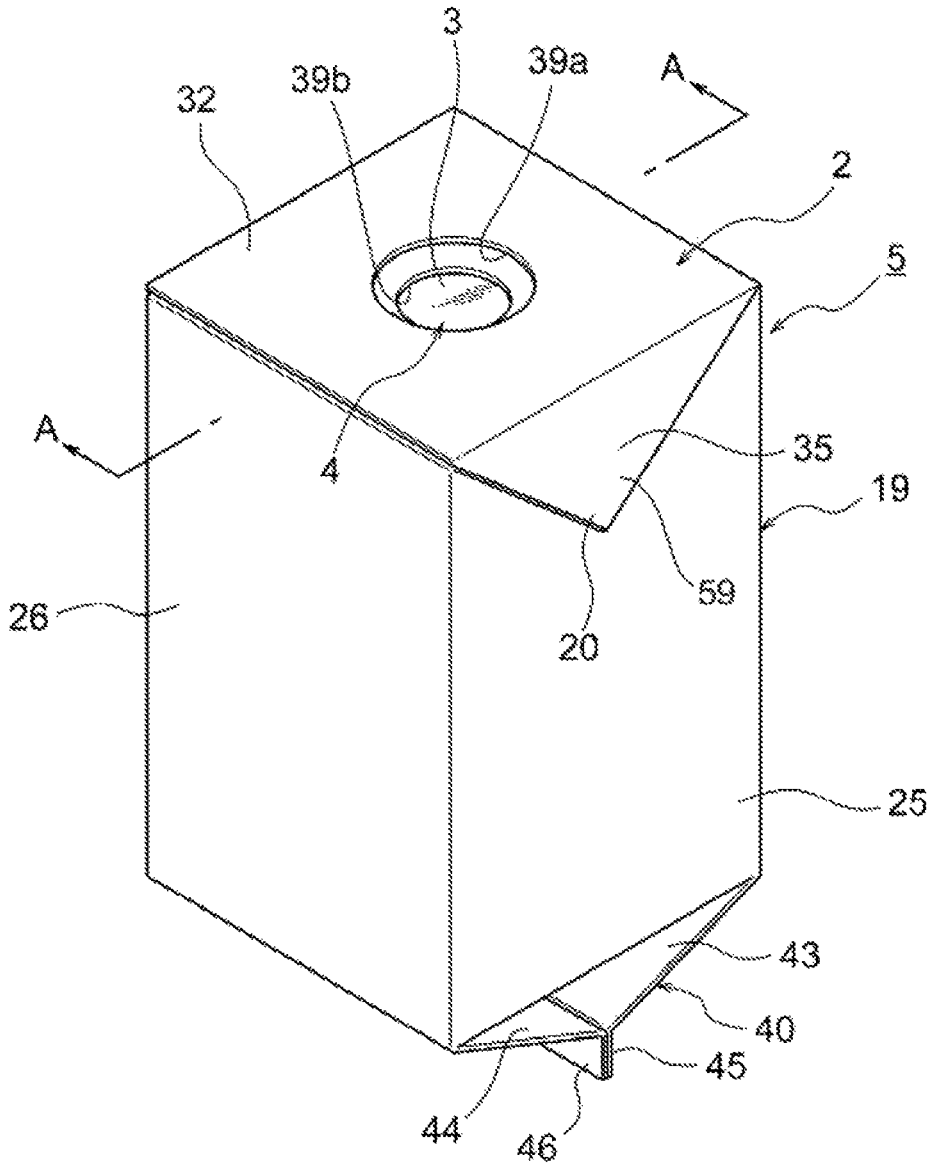
FIG. 2 is a perspective view for illustrating an inner container of the refillable container illustrated in FIG. 1.
Figure 3:
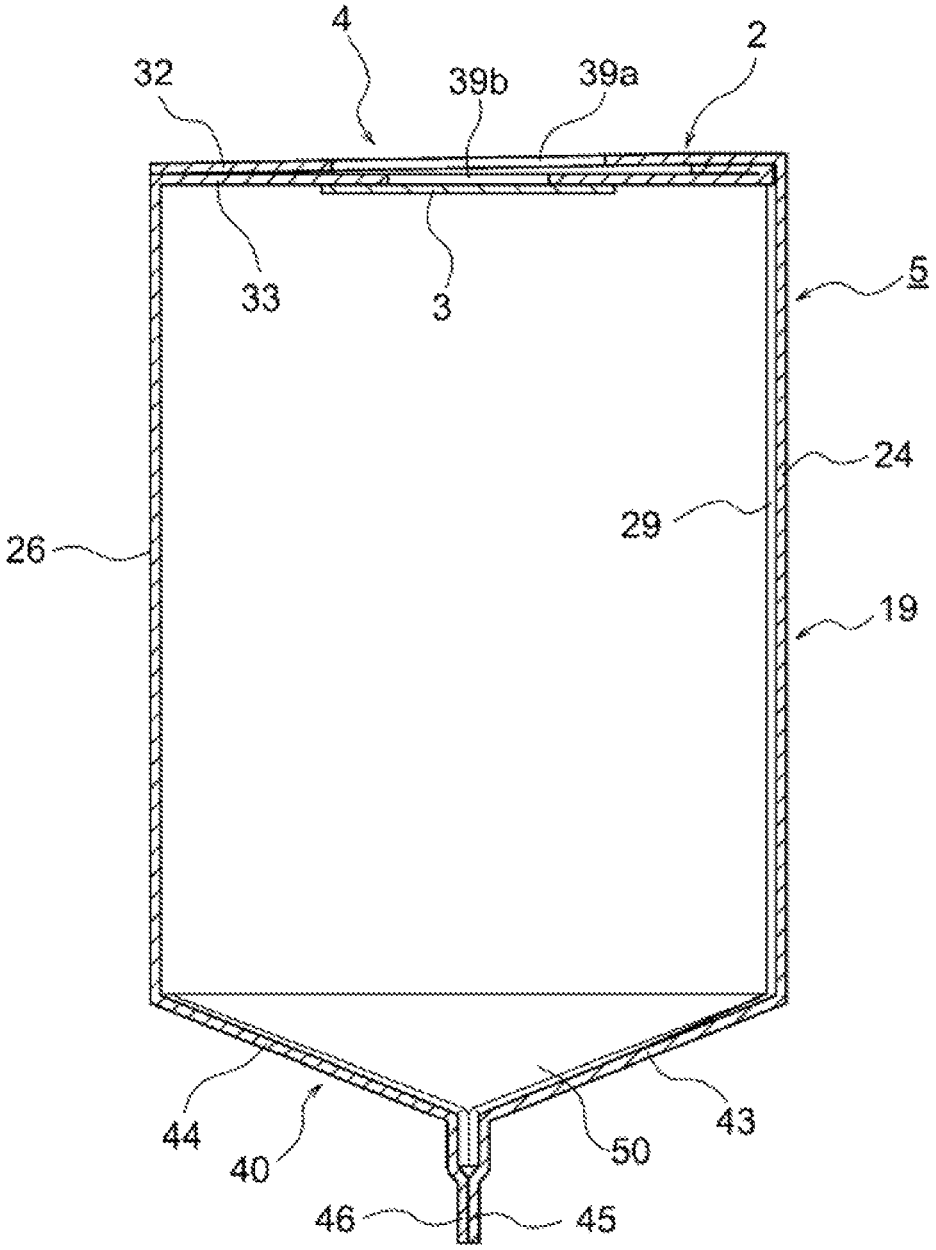
FIG. 3 is a sectional view taken along the line A-A of FIG. 2.
Figure 4:
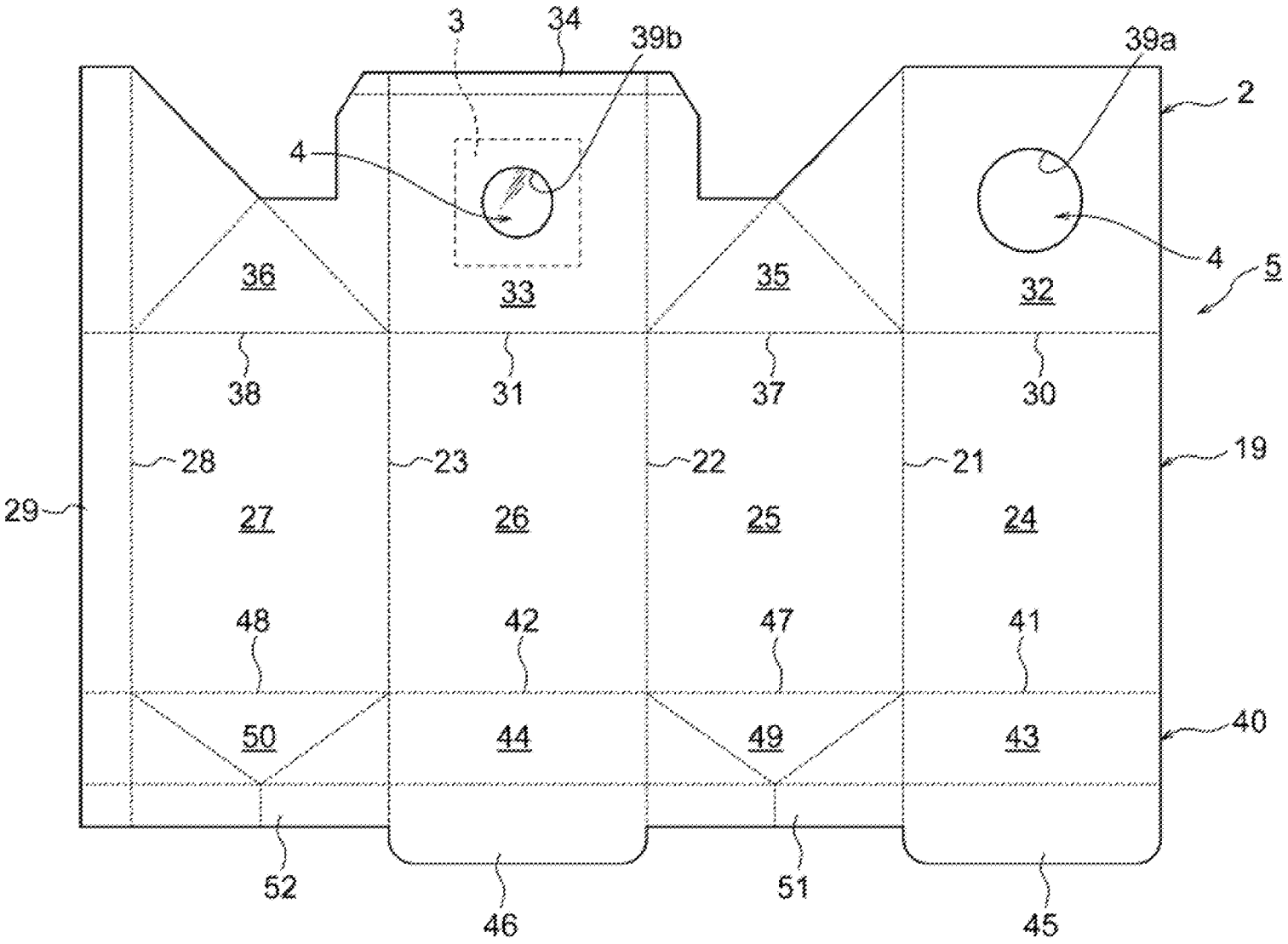
FIG. 4 is a developed view for illustrating a carton blank before an assembly process of the inner container illustrated in FIG. 2.
Figure 5:
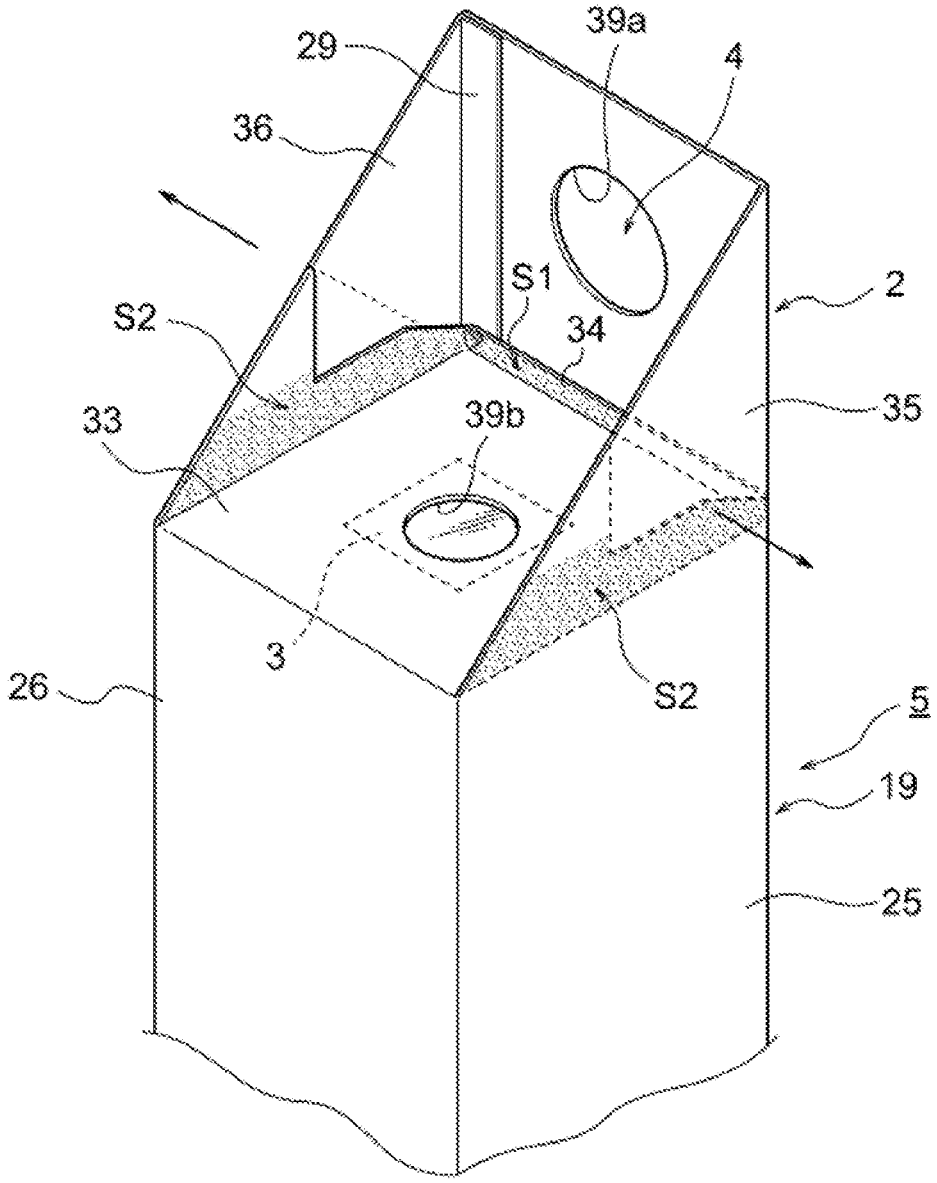
FIG. 5 is an explanatory view for illustrating a step of forming an upper surface of the inner container illustrated in FIG. 2.
Figure 6:
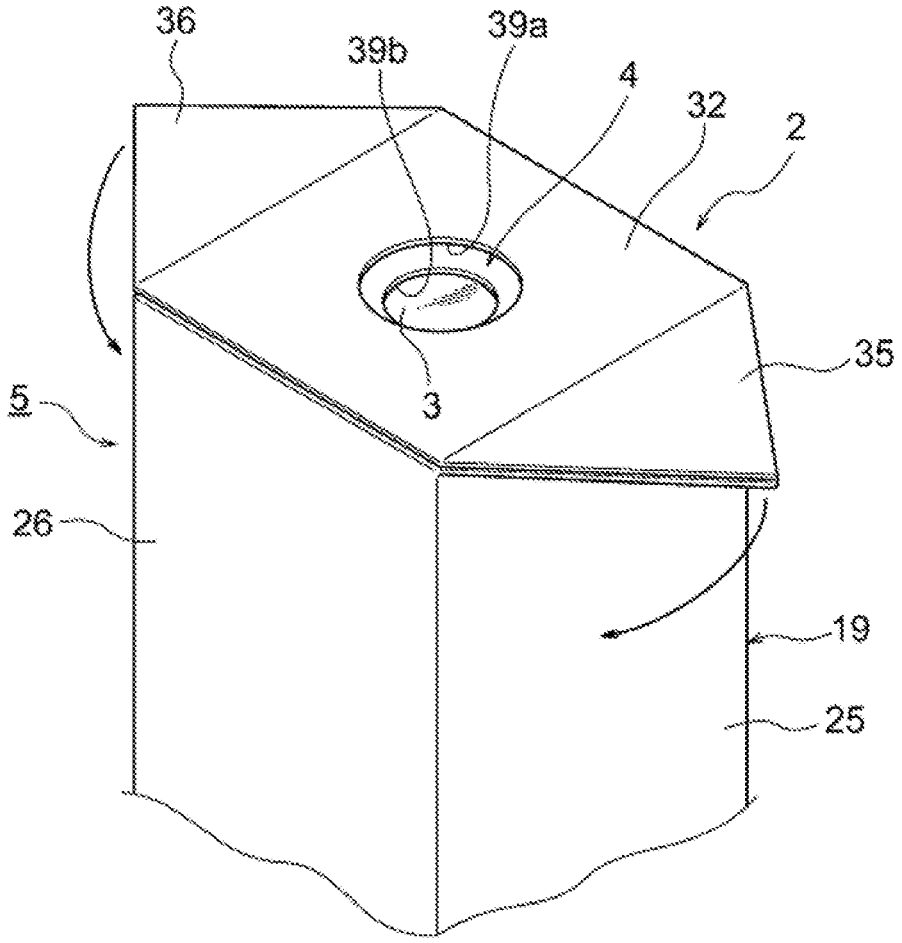
FIG. 6 is an explanatory view for illustrating a step of forming the upper surface of the inner container illustrated in FIG. 2.
Figure 7:
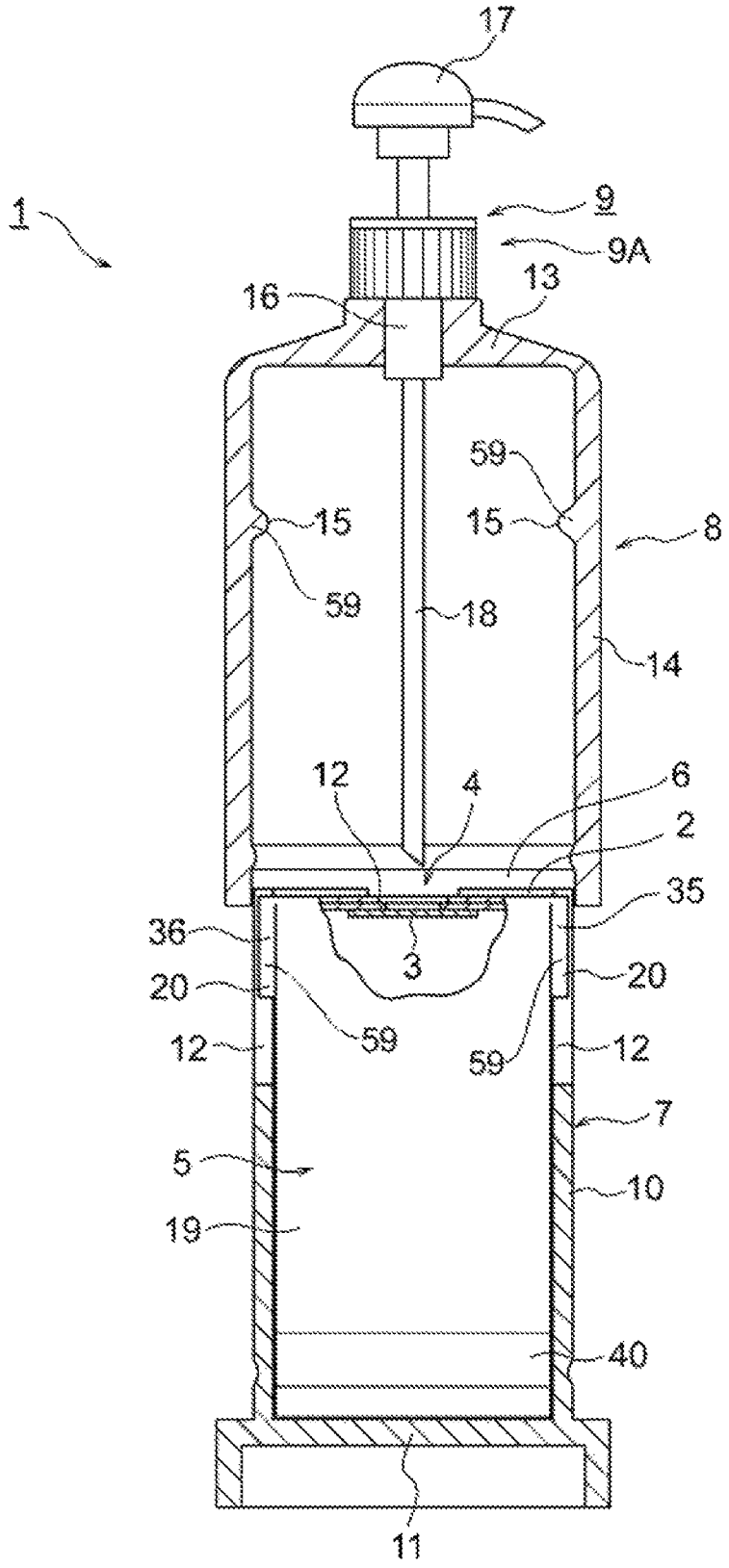
FIG. 7 is a sectional view for illustrating a process of closing an accommodation member accommodating the inner container by a lid member in the refillable container illustrated in FIG. 1.
Figure 8:
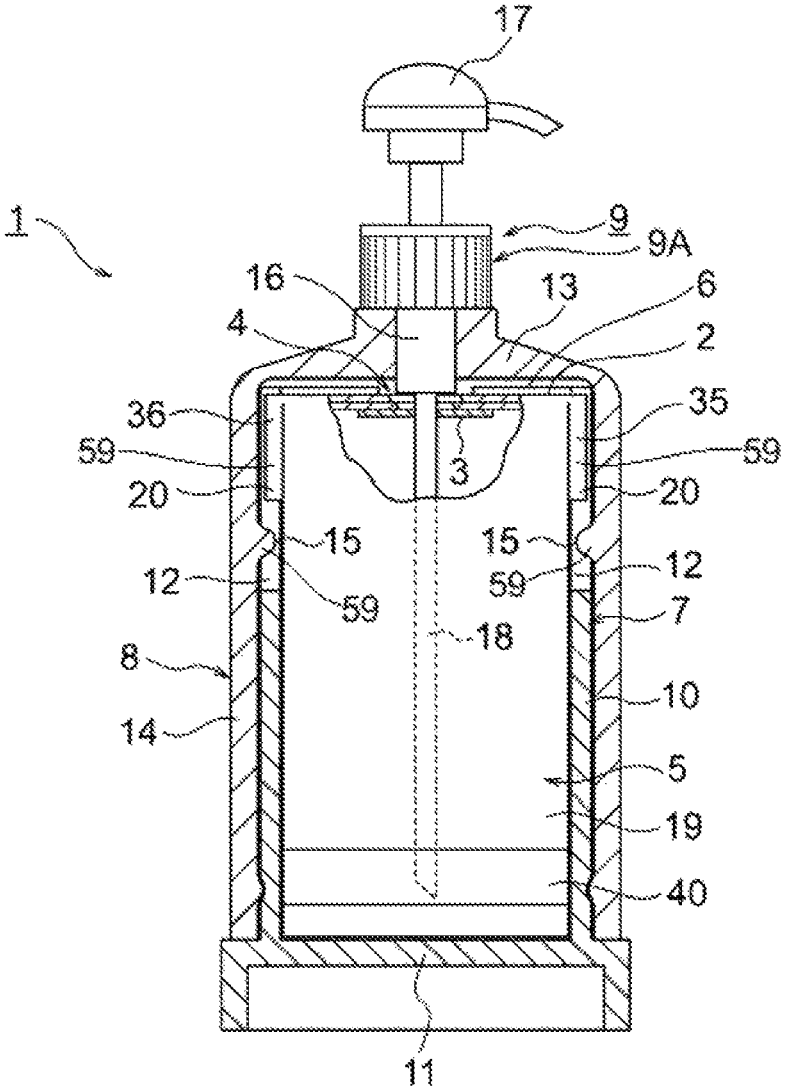
FIG. 8 is a sectional view for illustrating a state in which the accommodation member accommodating the inner container is closed by the lid member in the refillable container illustrated in FIG. 1.
Figure 9:
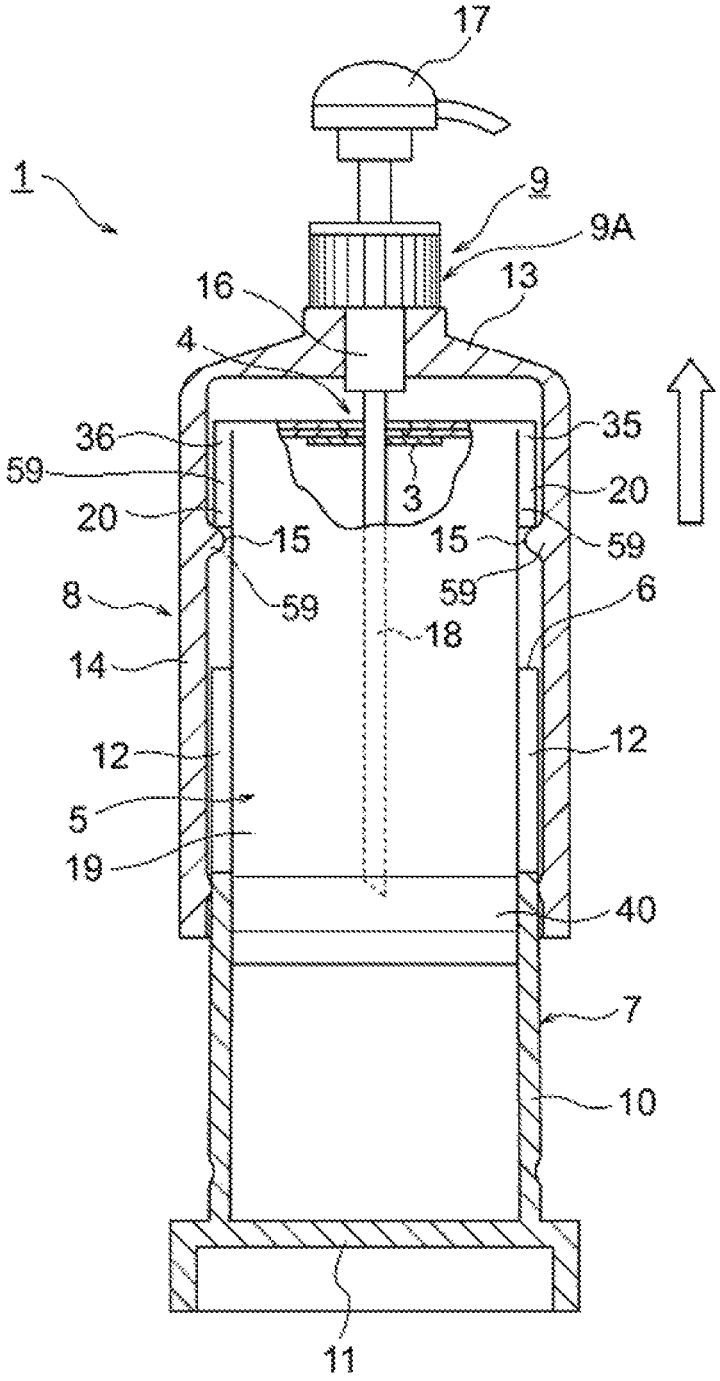
FIG. 9 is a sectional view for illustrating a state in which the lid member is removed from the accommodation member accommodating the inner container in the refillable container illustrated in FIG. 1.
Figure 10:
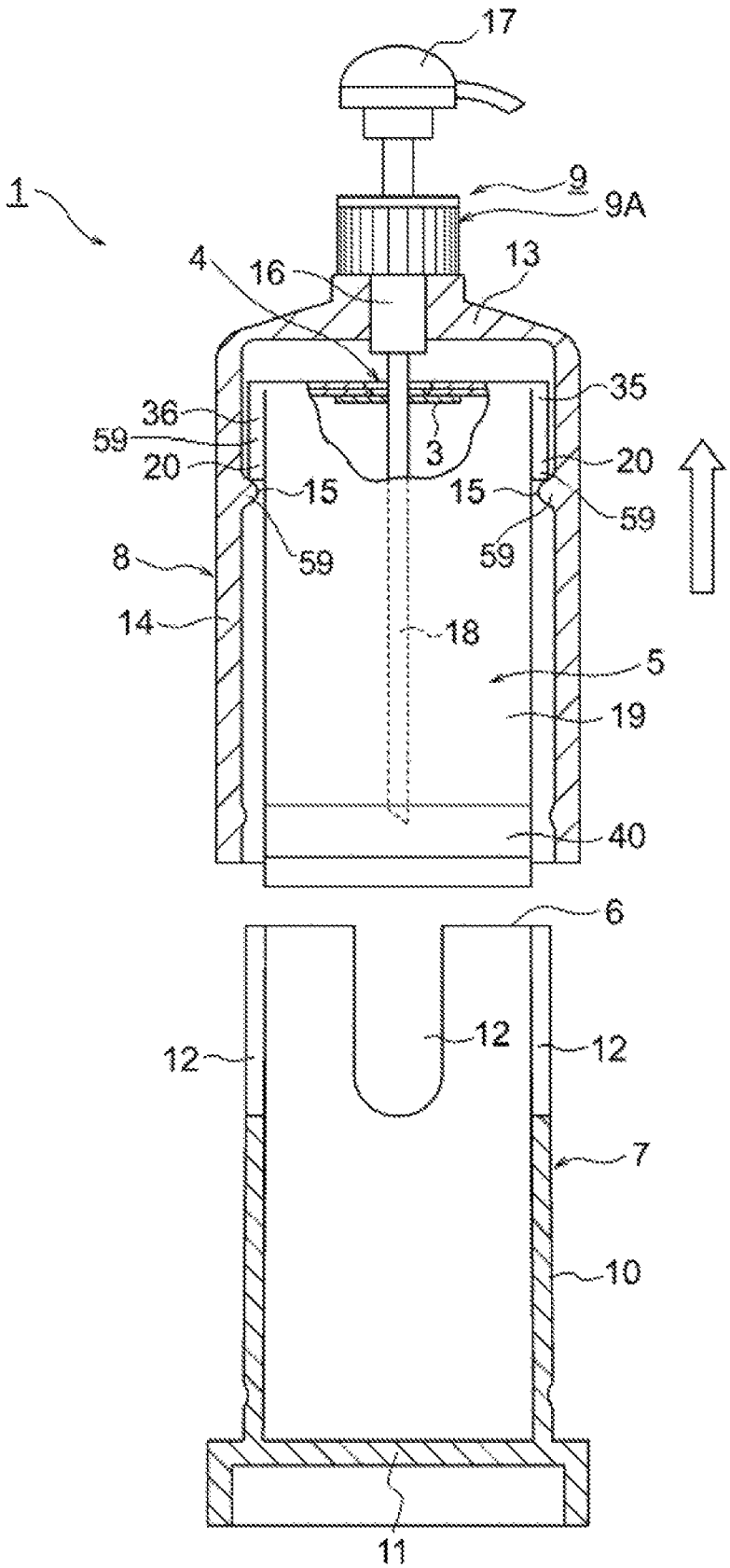
FIG. 10 is a sectional view for illustrating a state in which the lid member has been removed from the accommodation member accommodating the inner container in the refillable container illustrated in FIG. 1.

FIG. 1 to FIG. 10 are views for illustrating a first example of a refillable container according to an embodiment of the present invention. FIG. 1 is an exploded sectional view of the refillable container of this example. FIG. 2 is a perspective view for illustrating an inner container in the refillable container illustrated in FIG. 1. FIG. 3 is a sectional view taken along a line A-A of FIG. 2. FIG. 4 is a developed view for illustrating a carton blank before an assembly process of the inner container illustrated in FIG. 2. FIG. 5 is an explanatory view for illustrating a step of forming an upper surface of the inner container illustrated in FIG. 2. FIG. 6 is an explanatory view for illustrating a step of forming the upper surface of the inner container illustrated in FIG. 2. FIG. 7 is a sectional view for illustrating a process of closing an accommodation member accommodating the inner container by a lid member in the refillable container illustrated in FIG. 1. FIG. 8 is a sectional view for illustrating a state in which the accommodation member accommodating the inner container is closed by the lid member in the refillable container illustrated in FIG. 1. FIG. 9 is a sectional view for illustrating a state in which the lid member is removed from the accommodation member accommodating the inner container in the refillable container illustrated in FIG. 1. FIG. 10 is a sectional view for illustrating a state in which the lid member has been removed from the accommodation member accommodating the inner container in the refillable container illustrated in FIG. 1.

A refillable container 1 of the first example includes an inner container 5, an accommodation member 7, a cylindrical lid member 8, a taking-out part 9, and an inner-container restraint part 59. The inner container 5 has a suction port 4, which is formed on an upper surface 2 and is sealed with a tearable sealing sheet 3. The inner container 5 is configured to contain a liquid content, and is replaced when the content has been exhausted. The accommodation member 7 has an accommodation opening 6 at an upper portion, and is configured to accommodate the inner container 5. The cylindrical lid member 8 is to be fitted to the accommodation member 7 accommodating the inner container 5, and is configured to close the accommodation member 7. The taking-out part 9 is configured to take out the content contained in the inner container 5 accommodated in the accommodation member 7. The inner-container restraint part 59 is provided between the lid member 8 and the inner container 5. The inner-container restraint part 59 is configured to restrain the lid member 8 and the inner container 5 so as to prevent the inner container 5 from falling from an opening portion of the lid member 8 by its own weight when the lid member 8 is removed from the accommodation member 7. The inner-container restraint part 59 is configured to release the restraint between the lid member 8 and the inner container 5 when the inner container 5 in which the content has been exhausted is pulled from the opening portion 62 of the lid member 8 in a pull-out direction.

First, description is made of the accommodation member 7.

A shape of the accommodation member 7 is not particularly limited as long as the accommodation member 7 can secure the inner container 5.

The accommodation member 7 of the first example is a cylindrical accommodation container 10 having the accommodation opening 6 at an upper portion. The accommodation container 10 is formed to have a shape corresponding to an outer shape of the inner container 5, and a cross-sectional shape of a body is a substantially square cylindrical shape in the first example.

A length of the accommodation container 10 is such that, when the inner container 5 is accommodated in the accommodation container 10, an end surface of the accommodation opening 6 of the accommodation container 10 is flush with an upper surface 2 of the inner container 5 or slightly exceeds the upper surface 2 of the inner container 5. In the first example, the accommodation container 10 is formed to have a length slightly exceeding the upper surface 2 of the inner container 5.

Further, the accommodation container 10 is formed with cutout portions 12 extending from the accommodation opening 6 to a bottom portion 11 side so as not to disturb movement of protruding portions formed on an inner surface of a cylindrical wall portion of the lid member 8 described later.

Next, description is made of the lid member 8.

The lid member 8 of the first example includes a top plate portion 13 and a cylindrical wall portion 14. The top plate portion 13 is configured to close the accommodation opening 6 of the accommodation container 10. The cylindrical wall portion 14 is fitted to an outer periphery of the accommodation container 10.

Next, description is made of the taking-out part 9 configured to take out the content contained in the inner container 5 accommodated in the accommodation member 7.

The taking-out part 9 of the first example is a discharge pump 9A which includes a tubular cylinder portion 16, a discharge nozzle 17, and a suction tube 18. The discharge nozzle 17 is provided at an upper portion of the tubular cylinder portion 16, and serves as an operation portion of a piston freely fitted to be slidable in the tubular cylinder portion 16. The suction tube 18 is provided at a lower portion of the tubular cylinder portion 16.

The discharge pump 9A serving as the taking-out part 9 thus configured is, in the first example, mounted to the lid member 8. Specifically, the tubular cylinder portion 16 penetrates the top plate portion 13 of the lid member 8 to be secured. The discharge nozzle 17 is arranged on an upper surface side of the top plate portion 13. The suction tube 18 is arranged on a lower surface side of the top plate portion 13. When the cylindrical wall portion 14 of the lid member 8 is fitted to the outer periphery of the accommodation container 10 to close the accommodation opening 6 of the accommodation container 10, the suction tube 18 arranged on the lower surface side of the top plate portion 13 of the lid member 8 tears the sealing sheet 3 arranged at the upper surface 2 of the inner container 5 accommodated in the accommodation container 10 to be inserted from the suction port 4 into the inner container 5.

Next, description is made of the inner container 5.

The inner container 5 of the first example has a body 19 having a substantially square shape in cross section, and is shaped to be accommodated in a state in which there is almost no space in the accommodation container 10.

The inner container 5 of the present example is made of a paper material formed with a resin layer on at least one side thereof, has four body panels 24, 25, 26, and 27 via body longitudinal folding lines 21, 22, and 23, and includes the body 19 formed into a rectangular tubular shape in which an edge portion of the body panel 24 is joined by a longitudinal seal panel 29 which is connected consecutively to the body panel 27 via a seal longitudinal folding line 28.

The upper surface 2 of the inner container 1 is configured as described below.

A pair of upper-surface forming panels 32 and 33, which face each other and overlap in the vertical direction, are continuously provided on upper edges of the body panels 24 and 26 through top horizontal folding lines 30 and 31. Further, a sealing panel 34 for sealing an inner surface of the upper-surface forming panel 32 is continuously provided on an upper edge of the upper-surface forming panel 32, which underlies the upper-surface forming panel 33.

Further, a pair of side panels 35 and 36 are continuously provided on upper edges of the body panels 25 and 26 through top horizontal folding lines 37 and 38. The pair of side panels 35 and 36 are positioned between the above-mentioned pair of upper-surface forming panels 32 and 33 to face each other and folded up along with overlapping of the pair of upper-surface forming panels 32 and 33.

Further, holes 39*a* and 39*b* are formed at centers of the upper-surface forming panels 32 and 33, respectively, to serve as a suction port 4. The holes 39*a* and 39*b* are opened so that a center of the hole 39*a* and a center of the hole 39*b* match with each other when the upper-surface forming panels 32 and 33 overlap. Further, a sealing sheet 3, which is tearable, is provided on a back surface of the upper-surface forming panel 33 so as to seal the hole 39*b*. A suction tube 18 of the discharge pump 9A forming the taking-out part 9 is stuck into the sealing sheet 3 so as to tear the film 3.

The sealing sheet 3 may be pasted on a back surface of an upper-surface forming panel 33, or may be formed integrally with a laminated product which is laminated on the paper material formed with the resin layer forming the inner container 5. Further, the sealing sheet 3 is not particularly limited to the material and the configuration described above as long as the sealing sheet 3 is impermeable and tearable. As the sealing sheet 3, a resin film, a metal foil, a sheet of paper, or a laminated body thereof is exemplified.

The upper surface 2 of the inner container 5 is formed by the upper-surface forming panels 32 and 33 and the side panels 35 and 36 as described below. After the body 19 is formed, first, the upper-surface forming panel 33 is folded inwardly. Along with that, the side panels 35 and 36 are folded up to inner surface sides into a triangular shape, and an upper accommodation opening of the body 19 is closed by the upper-surface forming panel 33. Then, the sealing panel 34, which is continuously provided on the upper edge of the upper-surface forming panel 33, is bonded to the inner surface of the upper-surface forming panel 32 in an area of S1 so as to seal the inner container 1. Both side edges of the upper-surface forming panel 33 are bonded to the side panels 35 and 36, which have been folded up into a triangular shape, in an area of S2 so as to seal the inner container 1 (see FIG. 5).

Next, the side panels 35 and 36 are folded up outwardly (in directions indicated by the arrows in FIG. 5) so that the upper-surface forming panel 32 overlies the upper-surface forming panel 33 (see FIG. 6). The side panels 35 and 36, which have been folded up to protrude to an outside of the body 19, are folded downwardly (in directions indicated by the arrows in FIG. 6), and fixed to the body 11 with an adhesive or the like. Accordingly, the upper surface 2 is formed.

In the first example, the side panels 35 and 36 secured to the body 19 form protruding step portions 20 described later as the inner-container restraint part 59.

Further, in this example, the bottom surface 40 of the inner container 5 is configured as described below.

A pair of gable roof-shaped bottom surface forming panels 43 and 44, which face each other, are continuously provided on lower edges of the body panels 24 and 26 through bottom horizontal folding lines 41 and 42. Outer sealing panels 45 and 46, which have a belt-like shape, are continuously provided on lower parts of the gable roof-shaped bottom surface forming panels 43 and 44.

Further, a pair of gable wall-shaped bottom surface forming panels 49 and 50, which face each other, are continuously provided on lower edges of the body panels 25 and 27 through bottom horizontal folding lines 47 and 48. Inner sealing panels 51 and 52, which have a belt-like shape and a height smaller than that of the outer sealing panels 45 and 46, are continuously provided on lower parts of the gable wall-shaped bottom surface forming panels 49 and 50.

Further, the bottom surface 40 is formed by the gable roof-shaped bottom surface forming panels 43 and 44 and the gable wall-shaped bottom surface forming panels 49 and 50 as described below. The gable wall-shaped bottom surface forming panels 49 and 50 are folded in between the gable roof-shaped bottom surface forming panels 43 and 44, and facing surfaces of the outer sealing panels 45 and 46, which face each other, are bonded to each other to seal the inner container 1. Further, facing surfaces of the outer sealing panels 45 and 46 and facing surfaces of the inner sealing panels 51 and 52, and facing surfaces of the inner sealing panels 51 and 52 are bonded to each other to seal the inner container 1. Accordingly, the bottom surface 40 is formed into a reversed quadrangular pyramid shape of a so-called reversed gable top shape (see FIG. 2 and FIG. 3).

Next, description is made of the inner-container restraint part 59 configured to restrain the lid member 8 and the inner container 5.

In the first example, the inner-container restraint part 59 includes the protruding step portions 20 provided on an upper outer surface of the body 19 of the inner container 5 and protruding portions 15 provided on an inner surface of the cylindrical wall portion 14 of the lid member 8.

The protruding portions 15 provided on the inner surface of the cylindrical wall portion 14 of the lid member 8 are configured as follows. At the time of an operation of closing the accommodation container 10 by the lid member 8, the protruding portions 15 ride over the protruding step portions 20 provided on the upper outer periphery of the inner container 5 accommodated in the accommodation container 10. At the time of an operation of removing the lid member 8 from the accommodation container 10, the protruding portions 15 engage with lower sides of the protruding step portions 20 so as to restrain the inner container 5 and prevent the inner container 5 from falling from the opening portion 62 of the lid member 8 by its own weight, and the protruding step portions 20 can ride over the protruding portions 15 by pulling the inner container 5 from the opening portion 62 of the lid member 8.

The protruding portions 15 thus configured are provided intermittently in a circumferential direction on the inner surface of the cylindrical wall portion 14, and are provided at positions to be entered in the cutout portions 12 formed in the accommodation container 10 when the cylindrical wall portion 14 of the lid member 8 is fitted to the outer periphery of the accommodation container 10. A protruding height of the protruding portions 15 is preferably such that the protruding portions 15 do not protrude into the accommodation container 10 when the cylindrical wall portion 14 of the lid member 8 is fitted to the outer periphery of the accommodation container 10.

Further, the protruding step portion 20 provided on the upper outer surface of the body 19 of the inner container 5 preferably has a height so as not to protrude outside the accommodation container 10 when the inner container 5 is accommodated in the accommodation container 10.

The protruding step portions 20 provided on the upper outer periphery of the body 19 of the inner container 5 are, in the first example, provided on the outer peripheral surface of the body 19, and are provided at positions to be exposed from the cutout portions 12 formed in the accommodation container 10 in a state in which the inner container 5 has been accommodated in the accommodation container 10. In the first example, the side panels 35 and 36 secured to the body 19 of the inner container 5 form protruding step portions 20 provided on the outer peripheral surface of the body 19 of the inner container 5.

Refilling of the liquid content contained in the refillable container 1 thus configured is performed as follows.

The operation of refilling the liquid content contained in the refillable container 1 includes an accommodation operation and a taking-out operation. In the accommodation operation, the inner container 5 is accommodated in the accommodation container 10 serving as the accommodation member 7 in the refillable container 1. In the taking-out operation, the inner container 5 accommodated in the accommodation container 10 is taken out from the accommodation container 10.

In the accommodation operation of the inner container 5 in the accommodation container 10, first, the inner container 5 is accommodated in the accommodation container 10. The protruding step portions 20 provided on the outer peripheral surface of the body 19 of the inner container 5 accommodated in the accommodation container 10 are in a state to be exposed from the cutout portions 12 formed in the accommodation container 10 (see FIG. 7).

Next, the cylindrical wall portion 14 of the lid member 8 is fitted to the outer periphery of the accommodation container 10 accommodating the inner container 5 to close the accommodation opening 6 of the accommodation container 10.

In the process of closing the accommodation opening 6 of the accommodation container 10, the protruding portions 15 provided on the inner surface of the cylindrical wall portion 14 of the lid member 8 fitted to the outer periphery of the accommodation container 10 come into contact with the protruding step portions 20 exposed in the cutout portions 12 formed in the accommodation container 10. However, when the cylindrical wall portion 14 of the lid member 8 is pushed down, the protruding step portions 20 of the inner container 5 is elastically deformed due to pressing of the protruding portions 15, and the protruding portions 15 ride over the deformed protruding step portions 20 to move in the cutout portions 12.

Similarly, in the process of closing the accommodation opening 6 of the accommodation container 10, the suction tube 18 arranged on the lower surface side of the top plate portion 13 of the lid member 8 tears the sealing sheet 3 arranged at the upper surface 2 of the inner container 5 accommodated in the accommodation container 10 to be inserted from the suction port 4 into the inner container 5.

Further, when the cylindrical wall portion 14 of the lid member 8 fitted to the outer periphery of the accommodation container 10 is pushed down along the outer periphery of the accommodation container 10, the accommodation opening 6 of the accommodation container 10 is closed by the lid member 8, and the accommodation operation of the inner container 5 into the accommodation container 10 is completed (see FIG. 8).

When the liquid content contained in the inner container 5 accommodated in the accommodation container 10 has been exhausted, the lid member 8 is removed from the accommodation container 10, and the inner container 5 in which the liquid content has been exhausted is taken out from the accommodation container 10.

In the taking-out operation of the inner container 5 from the accommodation container 10, in the process of pulling up the lid member 8 to open the accommodation opening 6 of the accommodation container 10, the protruding portions 15 provided on the inner surface of the cylindrical wall portion 14 of the lid member 8 engage with lower sides of the protruding step portions 20 of the inner container 5 (see FIG. 9), and the inner container 5 is taken out from inside the accommodation container 10 integrally with the lid member 8 (see FIG. 10).

Then, through holding and pulling of the inner container 5 exposed from the opening portion 62 of the lid member 8, the protruding step portions 20 ride over the protruding portions 15 so that the inner container 5 can be taken out from the lid member 8.

In this way, the taking-out operation of the inner container 5 accommodated in the accommodation container 10 is completed.

In the first example, the accommodation opening 6 through which the inner container 5 is accommodated in the accommodation member 7 is open at the upper portion, but is not limited to this, and may be open at a side.

Further, in the first example, the taking-out part 9 is mounted to the lid member 8 to be integrated with the lid member 8, but is not always required to be mounted to the lid member 8.

Figure 11:
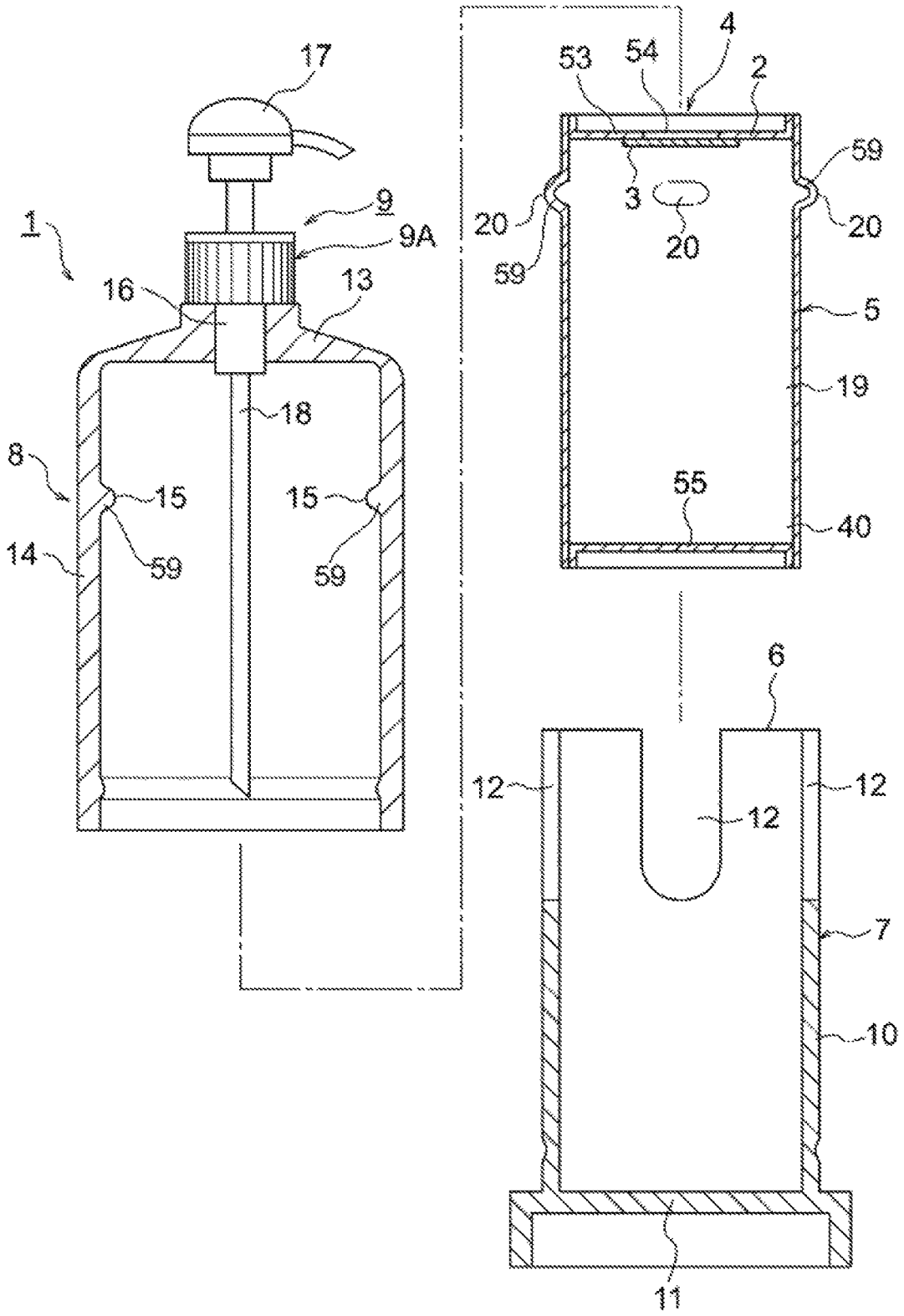
FIG. 11 is an exploded sectional view for illustrating a second example of the refillable container according to the embodiment of the present invention.
Figure 12:
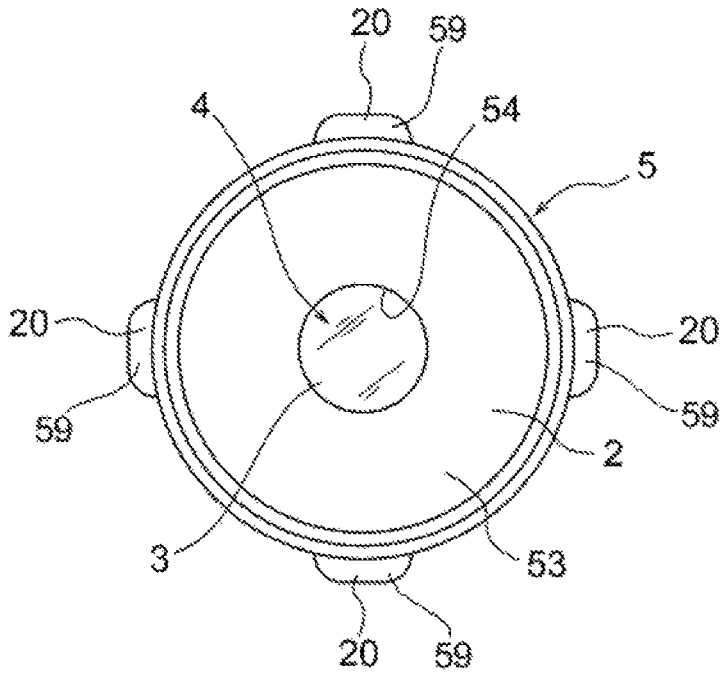
FIG. 12 is a plan view for illustrating the inner container in the refillable container illustrated in FIG. 11.
Figure 13:
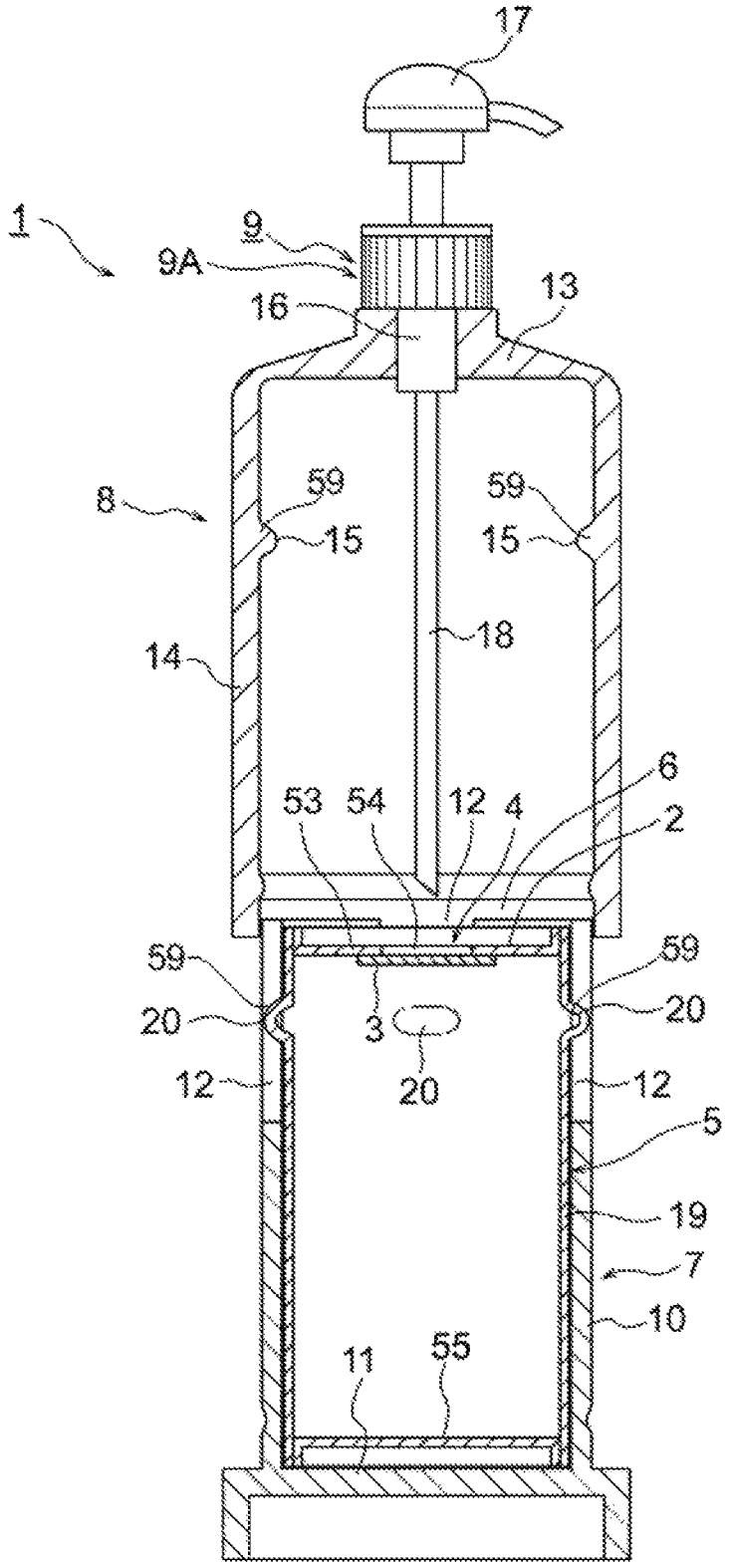
FIG. 13 is a sectional view for illustrating a process of closing the accommodation member accommodating the inner container by a lid member in the refillable container illustrated in FIG. 11.
Figure 14:
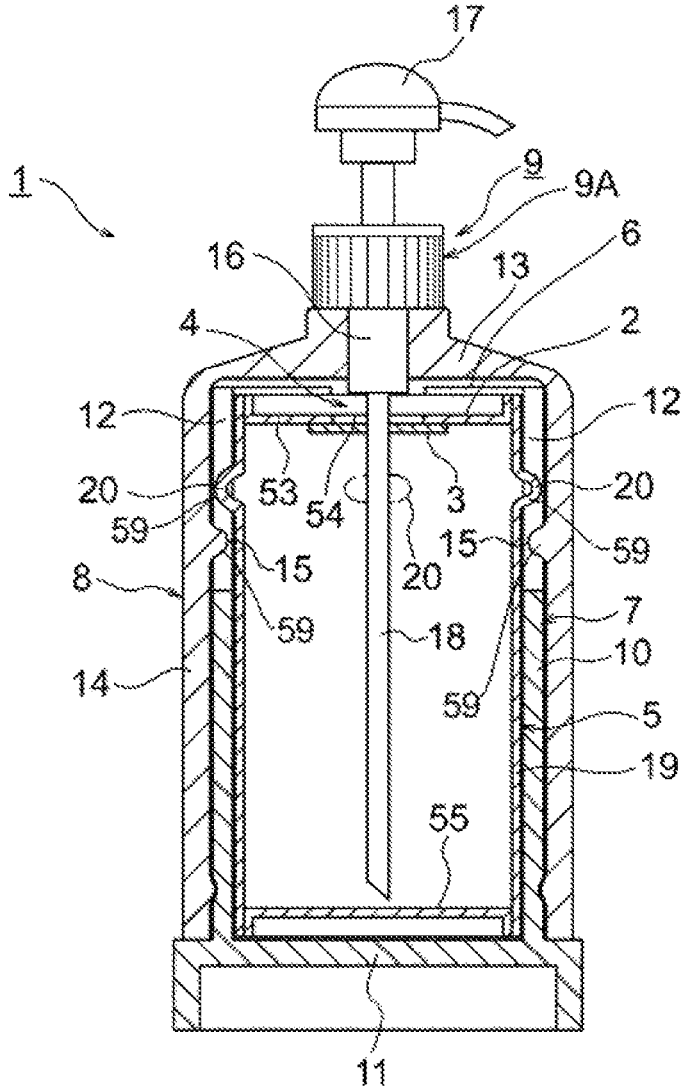
FIG. 14 is a sectional view for illustrating a state in which the accommodation member accommodating the inner container is closed by the lid member in the refillable container illustrated in FIG. 11.
Figure 15:
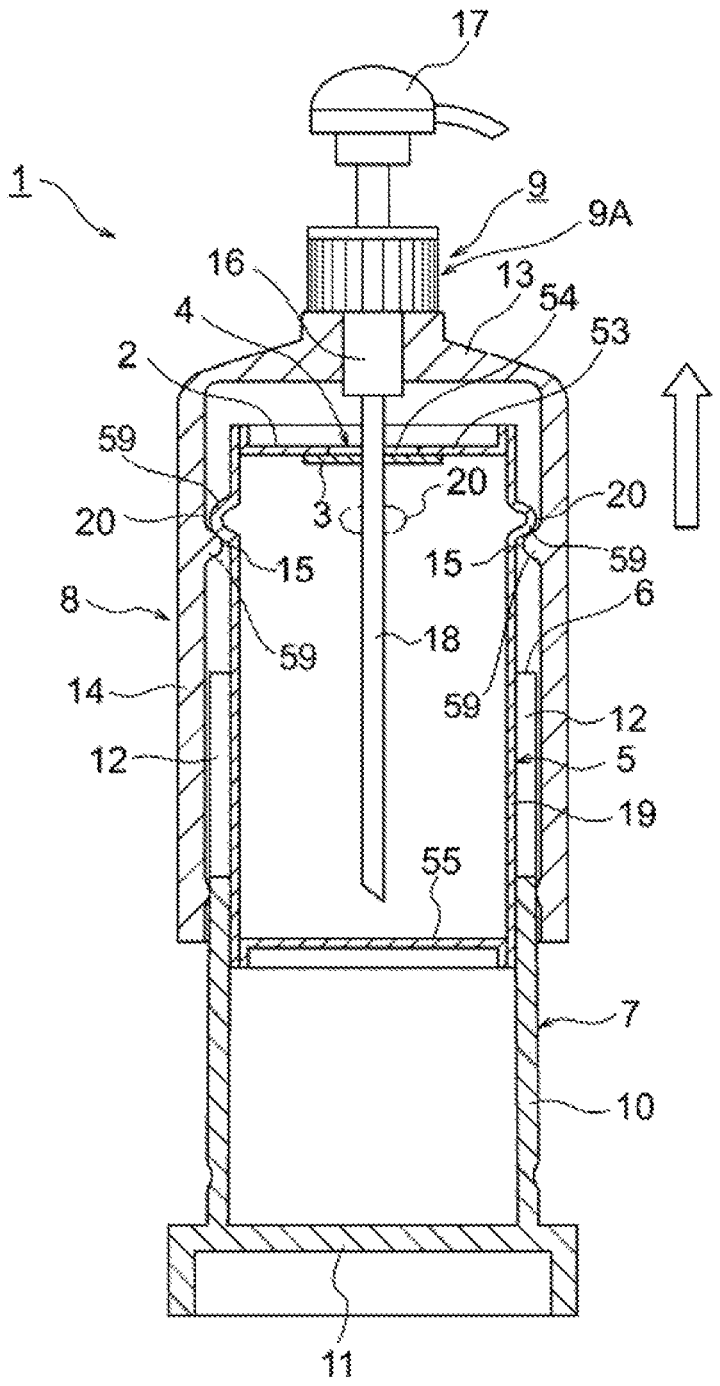
FIG. 15 is a sectional view for illustrating a state in which the lid member is removed from the accommodation member accommodating the inner container in the refillable container illustrated in FIG. 11.
Figure 16:
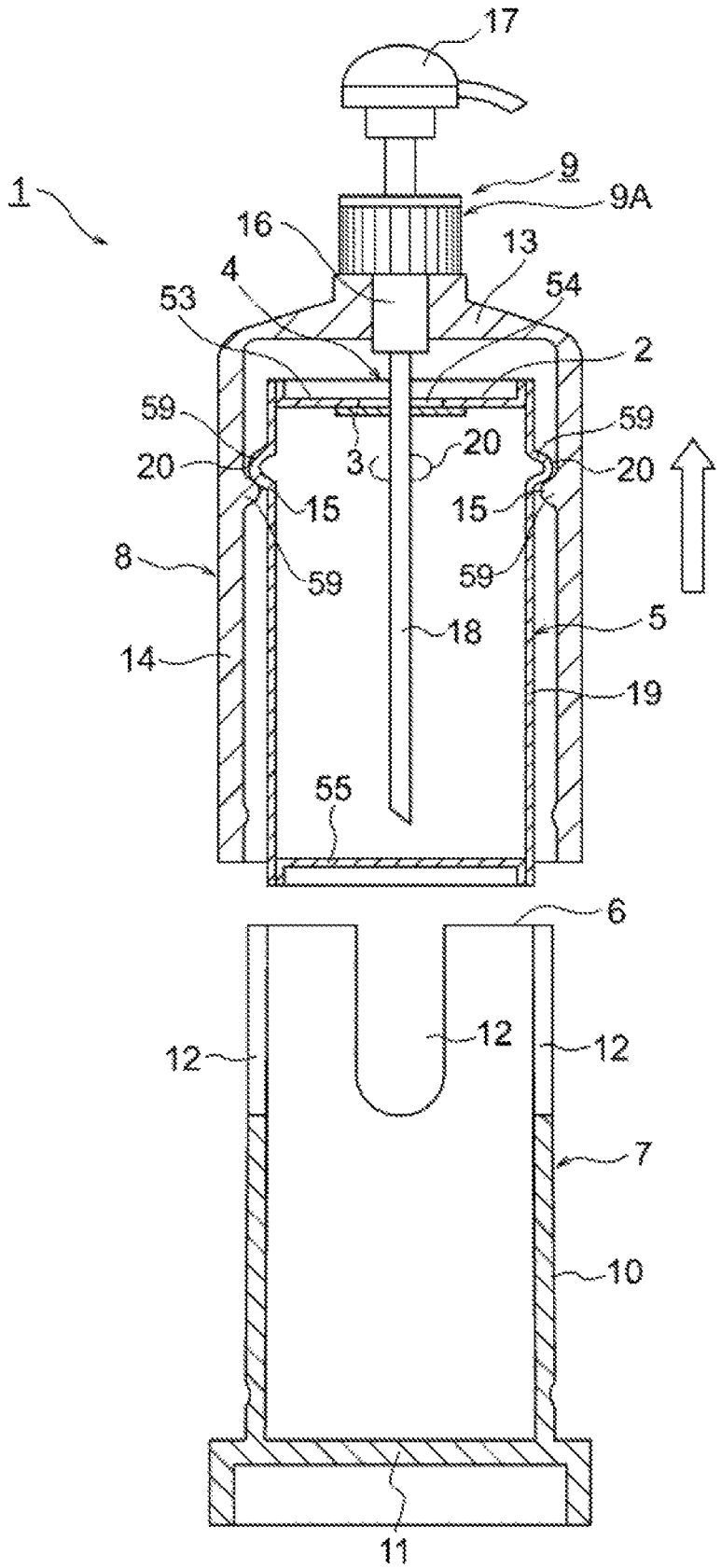
FIG. 16 is a sectional view for illustrating a state in which the lid member has been removed from the accommodation member accommodating the inner container in the refillable container illustrated in FIG. 11.

FIG. 11 to FIG. 16 are views for illustrating a second example of the refillable container according to the embodiment of the present invention. FIG. 11 is an exploded sectional view of the refillable container of the second example. FIG. 12 is a plan view for illustrating the inner container in the refillable container illustrated in FIG. 11. FIG. 13 is a sectional view for illustrating a process of closing the accommodation member accommodating the inner container by the lid member in the refillable container illustrated in FIG. 11. FIG. 14 is a sectional view for illustrating a state in which the accommodation member accommodating the inner container is closed by the lid member in the refillable container illustrated in FIG. 11. FIG. 15 is a sectional view for illustrating a state in which the lid member is removed from the container accommodating the inner container in the refillable container illustrated in FIG. 11. FIG. 16 is a sectional view for illustrating a state in which the lid member has been removed from the accommodation member accommodating the inner container.

The refillable container 1 of the second example is not different from the refillable container 1 of the first example in a basic configuration, and the same configurations as those of the first example are denoted with the same reference symbols for description.

This example is different from the first example in a shape of the inner container 5. The sectional shape of the body 19 is approximately circular.

The accommodation member 7 of the second example is, similarly to the first example, the accommodation container 10 having the accommodation opening 6 which is open at the upper portion, but the sectional shape of the body is formed in a cylindrical shape to correspond to the outer shape of the inner container 5. Further, the shape of the lid member 8 is also a cylindrical shape in which the cylindrical wall portion 14 is fitted to the outer periphery of the accommodation member 7. Other configurations are the same as those in the first example.

The inner container 5 of the second example has the body in a cylindrical shape in cross section and has a shape to be accommodated in the accommodation container 10 serving as the accommodation member 7 with almost no space.

In the second example, the inner container 5 is formed of a paper material having a thermoplastic resin layer at least on the inner surface, and has the body 19 formed in a cylindrical shape by both side edges of the rectangular paper material joined with each other.

On the outer peripheral surface of the body 19 of the inner container 5, the protruding step portions 20 serving as the inner-container restraint part 59 are provided. The protruding step portions 20 provided on the upper outer peripheral surface of the body 19 are arranged at positions exposed from the cutout portions 12 formed in the accommodation container 10 in a state in which the inner container 5 is accommodated in the accommodation container 10.

The protruding height of the protruding step portions 20 is, similarly to the first example, preferably a height with which the protruding step portions 20 do not protrude outside the accommodation container 10 when the inner container 5 is accommodated in the accommodation container 10.

The protruding step portions 20 provided on the outer peripheral surface of the body 19 of the inner container 5 are formed of the paper material by a pressing die.

At an upper opening portion of the body 19, a top plate 53 is provided to serve as the upper surface 2. The top plate 53 has a hole 54 which is located at the center and serves as the suction port 4, and, on a back surface of the top plate 53, the sealing sheet 3 is provided so as to close the hole 54 and can be broken by penetrating the suction tube 18 of the discharge pump 9A.

Further, a bottomplate 55 is provided at a lower opening portion of the body 19.

Refilling of the liquid content contained in the refillable container 1 thus configured is performed in the same manner as that in the first example.

In the accommodation operation of the inner container 5 in the accommodation container 10, first, the inner container 5 is accommodated in the accommodation container 10. The protruding step portions 20 provided on the outer peripheral surface of the body 19 of the inner container 5 accommodated in the accommodation container 10 are in a state to be exposed from the cutout portions 12 formed in the accommodation container 10 (see FIG. 13).

Next, the cylindrical wall portion 14 of the lid member 8 is fitted to the outer periphery of the accommodation container 10 accommodating the inner container 5 to close the accommodation opening 6 of the accommodation container 10.

In the process of closing the accommodation opening 6 of the accommodation container 10, the protruding portions 15 provided on the inner surface of the cylindrical wall portion 14 of the lid member 8 fitted to the outer periphery of the accommodation container 10 come into contact with the protruding step portions 20 exposed in the cutout portions 12 which are formed in the accommodation container 10, and similarly to the first example, the protruding step portions 20 are elastically deformed, and the protruding portions 15 ride over the protruding step portions 20 to move in the cutout portions 12.

Similarly, in the process of closing the accommodation opening 6 of the accommodation container 10, the suction tube 18 arranged on the lower surface side of the top plate portion 13 of the lid member 8 tears the sealing sheet 3 arranged at the upper surface 2 of the inner container 5 accommodated in the accommodation container 10 to be inserted from the suction port 4 into the inner container 5.

Further, when the cylindrical wall portion 14 of the lid member 8 fitted to the outer periphery of the accommodation container 10 is pushed down along the outer periphery of the accommodation container 10, the accommodation opening 6 of the accommodation container 10 is closed by the lid member 8 (see FIG. 14).

When the liquid content contained in the inner container 5 accommodated in the accommodation container 10 has been exhausted, the lid member 8 is removed from the accommodation container 10, and the inner container 5 is taken out from the accommodation container 10.

In the taking-out operation of the inner container 5 from the accommodation container 10, similarly to the first example, in the process of pulling up the lid member 8 to open the accommodation opening 6 of the accommodation container 10, the protruding portions 15 provided on the inner surface of the cylindrical wall portion 14 of the lid member 8 engage with lower sides of the protruding step portions 20 of the inner container 5 (see FIG. 15), and the inner container 5 is taken out from inside the accommodation container 10 integrally with the lid member 8 (see FIG. 16).

Then, through holding and pulling of the inner container 5 exposed from the opening portion 62 of the lid member 8, the protruding step portions 20 ride over the protruding portions 15 so that the inner container 5 can be taken out from the lid member 8.

In the second example, the accommodation opening 6 through which the inner container 5 is accommodated in the accommodation member 7 is open at the upper portion, but is not limited to this, and may be open at a side.

Further, in the second example, the taking-out part 9 is mounted to the lid member 8 to be integrated with the lid member 8, but is not always required to be mounted to the lid member 8.

Figure 17:
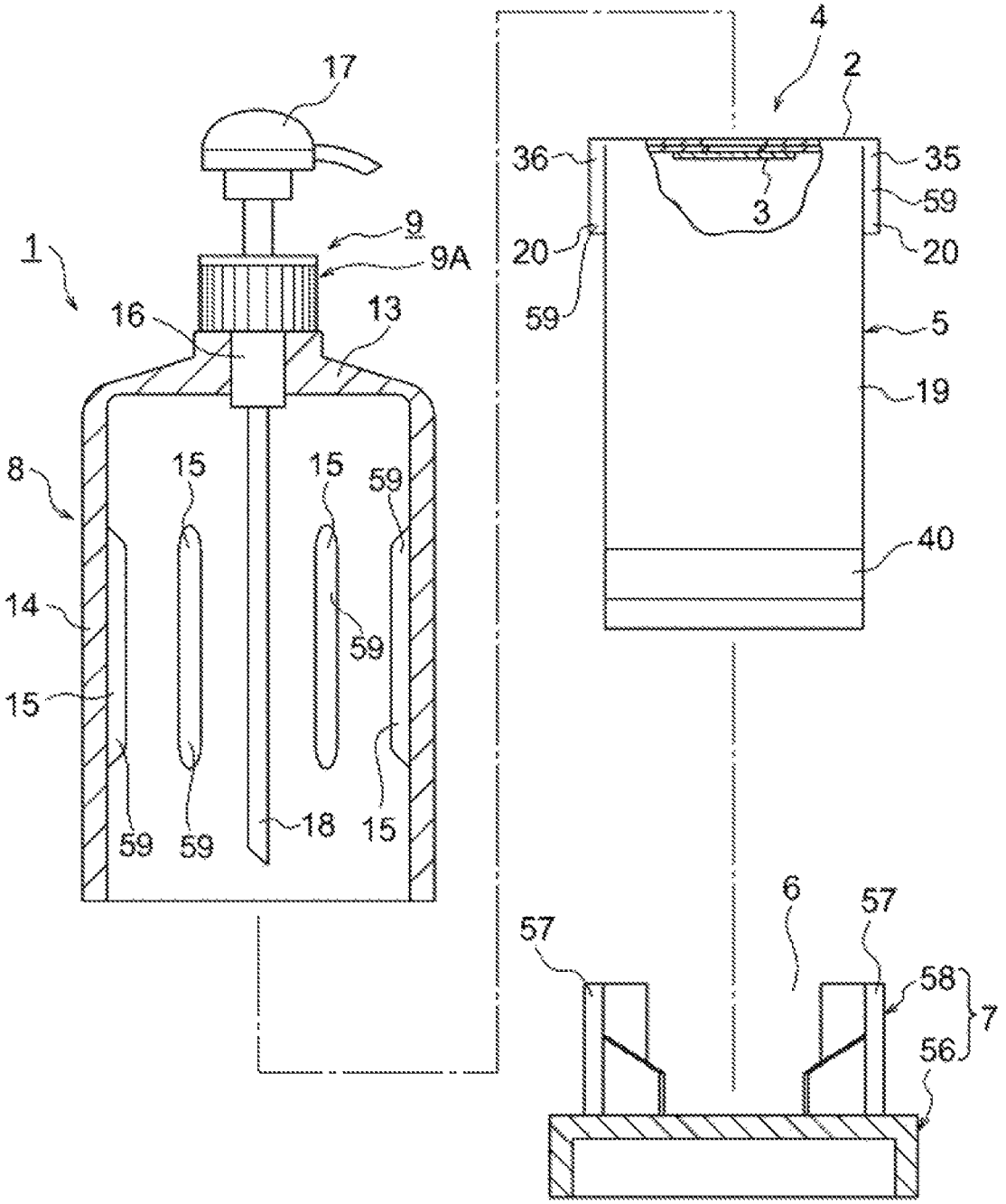
FIG. 17 is an exploded sectional view for illustrating a third example of the refillable container according to the embodiment of the present invention.
Figure 18:
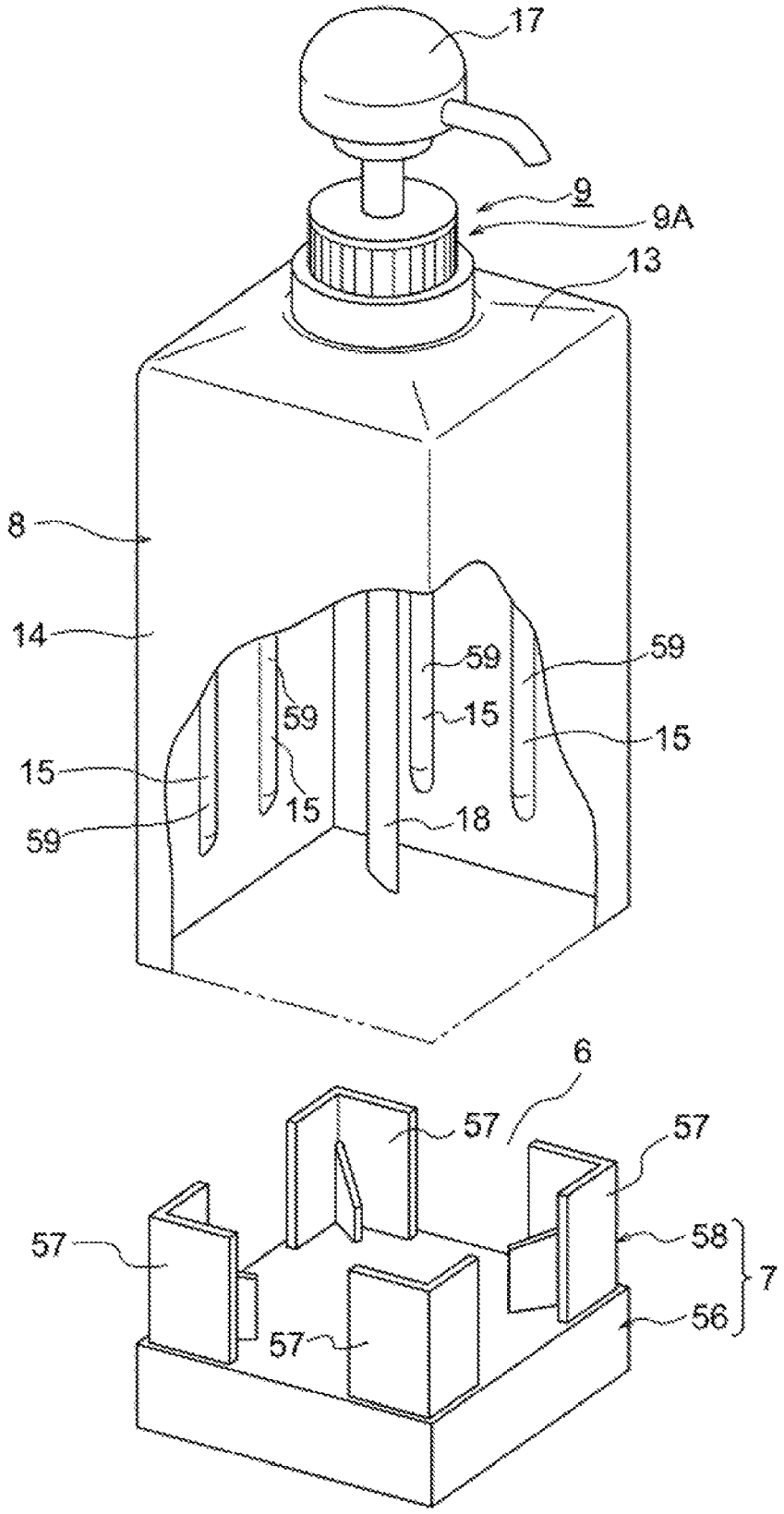
FIG. 18 is a partially cutaway perspective view for illustrating the accommodation member and a lid member in the refillable container illustrated in FIG. 17.
Figure 19:
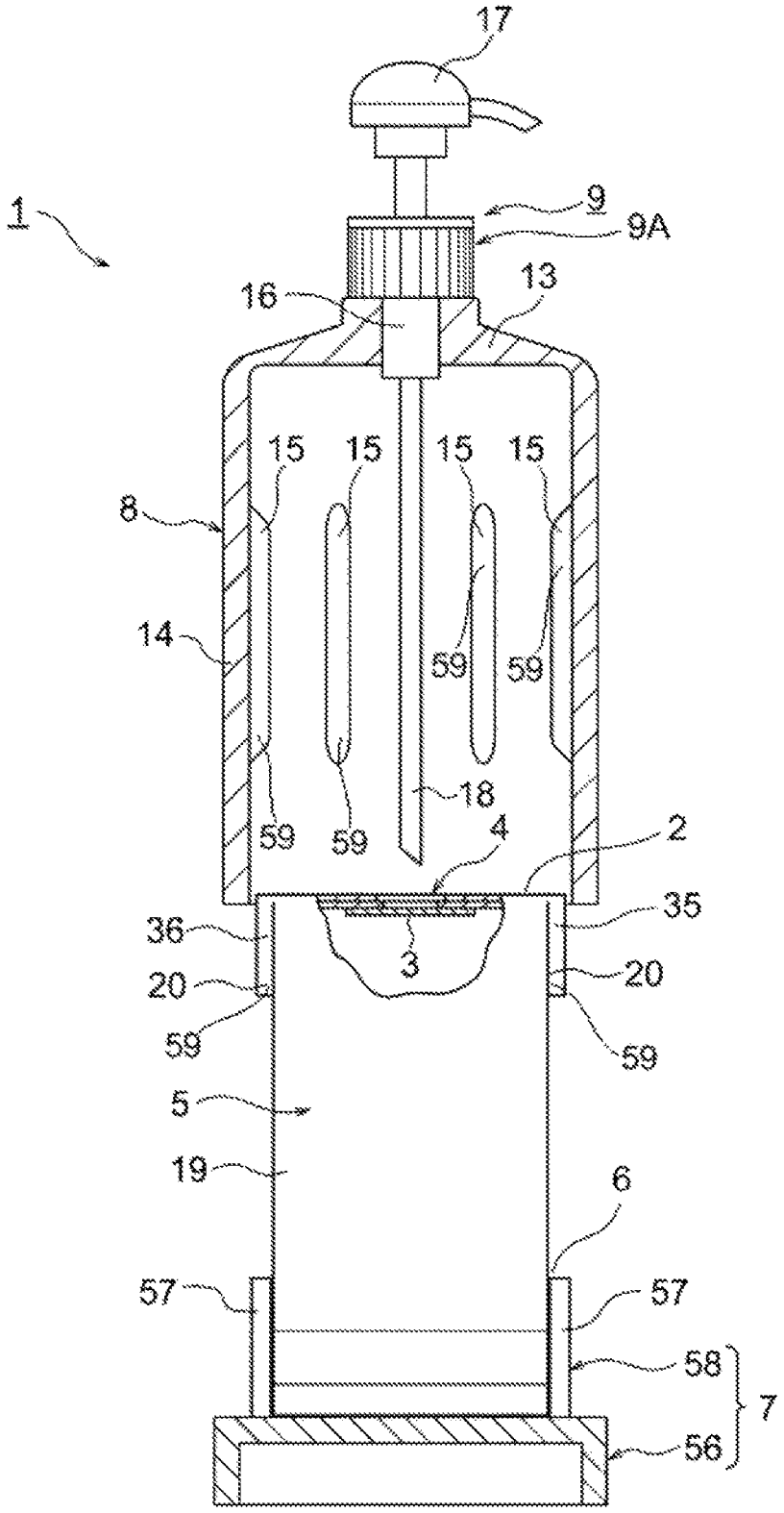
FIG. 19 is a sectional view for illustrating a process of closing the accommodation member accommodating the inner container by a lid member in the refillable container illustrated in FIG. 17.
Figure 20:
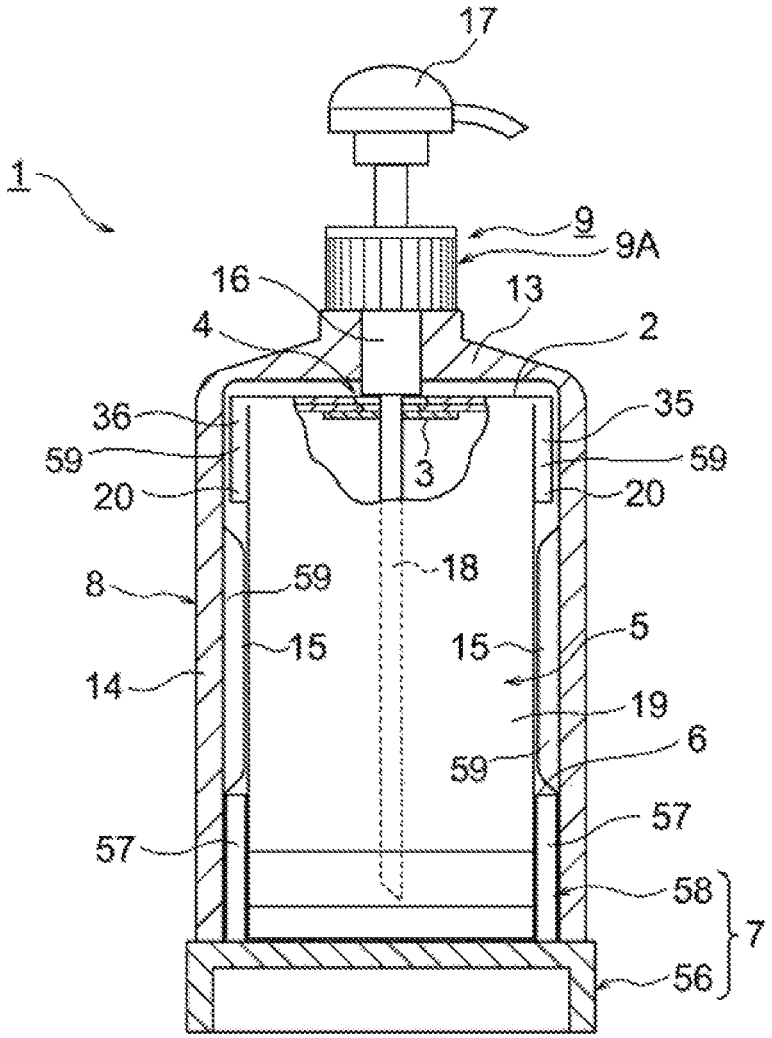
FIG. 20 is a sectional view for illustrating a state in which the accommodation member accommodating the inner container is closed by the lid member in the refillable container illustrated in FIG. 17.
Figure 21:
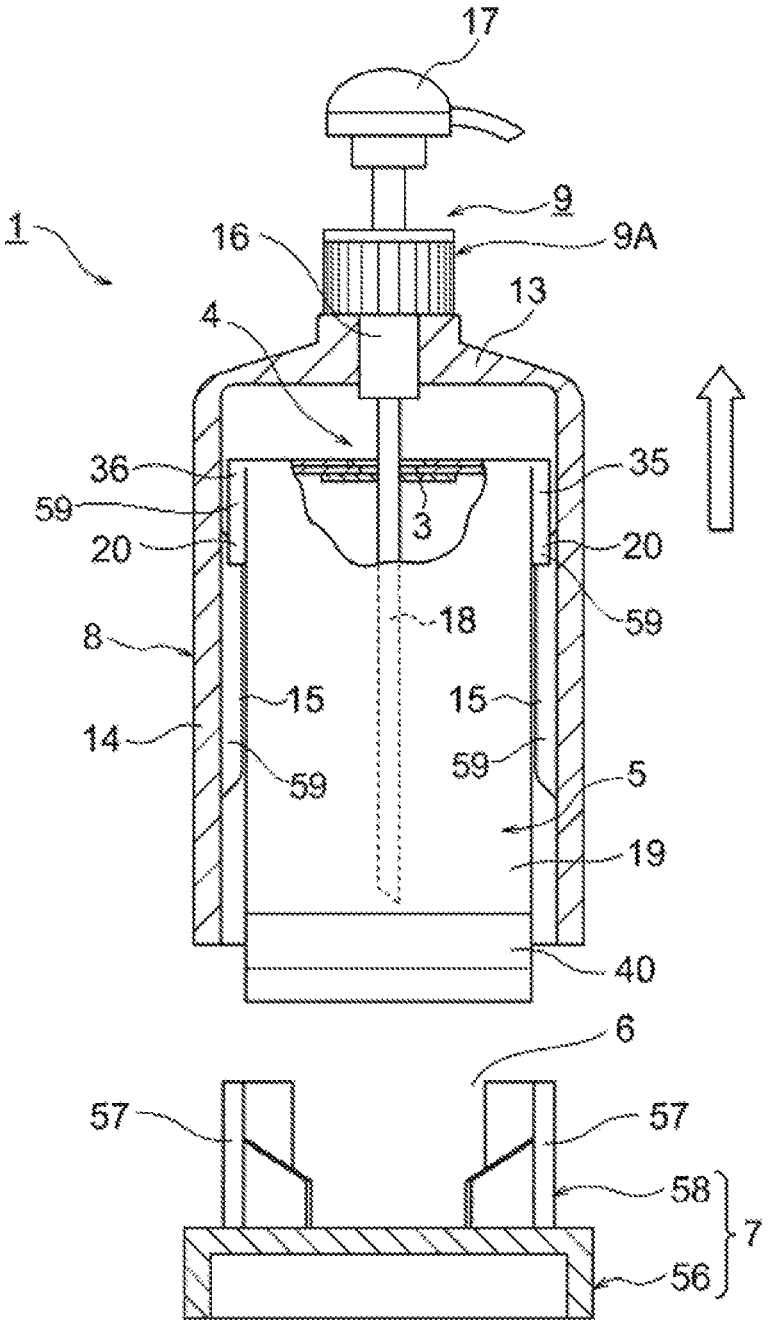
FIG. 21 is a sectional view for illustrating a state in which the lid member is removed from the accommodation member accommodating the inner container in the refillable container illustrated in FIG. 17.

FIG. 17 to FIG. 21 are views for illustrating a third example of the refillable container according to the embodiment of the present invention. FIG. 17 is an exploded sectional view of the refillable container of the third example. FIG. 18 is a partially cutaway perspective view for illustrating the accommodation member and the lid member in the refillable container illustrated in FIG. 17. FIG. 19 is a sectional view for illustrating a process of closing the accommodation container accommodating the inner container by the lid member in the refillable container illustrated in FIG. 17. FIG. 20 is a sectional view for illustrating a state in which the accommodation member accommodating the inner container is closed by the lid member. FIG. 21 is a sectional view for illustrating a state in which the lid member is removed from the accommodation member accommodating the inner container in the refillable container illustrated in FIG. 17.

The refillable container 1 of the third example is not different from the refillable container 1 of the first example in a basic configuration, and the same configurations as those of the first example are denoted with the same reference symbols for description.

This example is different from the first example in the accommodation member 7 configured to accommodate the inner container 5, and other configurations are the same as those of the first example.

The accommodation member 7 of this example includes a support base portion 56 and a support frame portion 58 in which a plurality of support pieces 57 along the outer surface of the body 19 of the inner container 5 are vertically provided at intervals on an upper surface of the support base portion 56, and the inner container 5 is accommodated inside the support frame portion 58.

The inner container 5 of this example has the same configuration as the inner container 5 of the first example. As the support pieces 57 vertically provided on the upper surface of the support base 56, four support pieces 57 are vertically provided so as to correspond to corner portions of the inner container 5 having the body 19 approximately in a rectangular shape in cross section. Each support piece 57 has an angle inner surface which supports both side surfaces of the corner portion of the inner container 5. When the inner container 5 is inserted into the support frame portion 58 from the accommodation opening 6 formed at an upper portion of the support frame portion 58 formed by the four support pieces 57, each corner portion of the inner container 5 is accommodated on the angle inner surface of each piece 57 with almost no clearance.

Further, the height of the support pieces 57 vertically provided on the upper surface of the support base portion 56 is not particularly limited as long as the support pieces 57 have a height by which the inner container 5 inserted into the support frame portion 58 can be stably supported.

Still further, the protruding portions 15 provided on the inner surface of the cylindrical wall portion 14 of the lid member 8 are, in this example, provided linearly in an axial direction of the cylindrical wall portion 14, and the protruding portions 15 are provided so as to be positioned between the support pieces 57 of the support frame portion 58 serving as the accommodation member 7 when the accommodation member 7 is closed by the lid member 8.

Yet further, in this example, when the inner container 5 is accommodated in the support frame portion 58 serving as the accommodation member 7, the protruding step portions 20 provided on the outer peripheral surface of the body 19 in the inner container 5 are provided so as to be positioned above the accommodation opening 6 of the support frame portion 58, but the protruding step portions 20 are provided to be positioned between the support pieces 57 when the protruding step portions 20 provided on the outer peripheral surface of the body 19 of the inner container 5 are provided to be positioned below the accommodation opening 6 of the support frame portion 58.

Refilling of the liquid content contained in the refillable container 1 thus configured is performed in the same manner as that in the first example.

In the accommodation operation of the inner container 5 into the accommodation member 7, first, the inner container 5 is accommodated in the support frame portion 58 serving as the accommodation member 7. The protruding step portions 20 provided on the outer peripheral surface of the body 19 of the inner container 5 accommodated in the support frame portion 58 are exposed above the accommodation opening 6 of the support frame portion 58 (see FIG. 19). Further, when the protruding step portions 20 provided on the outer peripheral surface of the body 19 in the inner container 5 are provided so as to be positioned below the accommodation opening 6 of the support frame portion 58, the protruding step portions 20 are exposed between the support pieces 57 (not shown).

Next, the cylindrical wall portion 14 of the lid member 8 is fitted to the outer periphery of the support frame portion 58 accommodating the inner container 5 to close the accommodation opening 6 of the support frame portion 58.

In the process of closing the accommodation opening 6 of the support frame portion 58, the linear protruding portions 15 provided on the inner surface of the cylindrical wall portion 14 of the lid member 8 come into contact with the protruding step portions 20 exposed from the support frame portion 58. Similarly to the first example, the protruding step portions 20 are elastically deformed and protruding portions 15 ride over the protruding step portions 20 to move, and further, end portions at an advancing side of the linear protruding portions 15 move between the support pieces 57 of the support frame portion 58.

Similarly, in the process of closing the accommodation opening 6 of the support frame portion 58, the suction tube 18 arranged on the lower surface side of the top plate portion 13 of the lid member 8 tears the sealing sheet 3 arranged at the upper surface 2 of the inner container 5 accommodated in the support frame portion 58 to be inserted from the suction port 4 into the inner container 5.

Further, when the cylindrical wall portion 14 of the lid member 8 fitted to the outer periphery of the support frame portion 58 is pushed down along the outer periphery of the accommodation container 10, the accommodation opening 6 of the support frame portion 58 is closed by the lid member 8 (see FIG. 20).

When the liquid content contained in the inner container 5 accommodated in the support frame portion 58 has been exhausted, the lid member 8 is removed from the support frame portion 58, and the inner container 5 is taken out from the support frame portion 58.

In the taking-out operation of the inner container 5 from the support frame portion 58, similarly to the first example, in the process of pulling up the lid member 8 to open the accommodation opening 6 of the support frame portion 58, the protruding portions 15 provided on the inner surface of the cylindrical wall portion 14 of the lid member 8 engage with lower sides of the protruding step portions 20 of the inner container 5, and the inner container 5 is taken out from inside the support frame portion 58 integrally with the lid member 8 (see FIG. 21).

Then, through holding and pulling of the inner container 5 exposed from the opening portion 62 of the lid member 8, the protruding step portions 20 ride over the protruding portions 15 so that the inner container 5 can be taken out from the lid member 8.

In the third example, the accommodation opening 6 through which the inner container 5 is accommodated in the accommodation member 7 is open at the upper portion, but is not limited to this, and may be open at a side.

Further, in the third example, the taking-out part 9 is mounted to the lid member 8 to be integrated with the lid member 8, but is not always required to be mounted to the lid member 8.

Figure 22:
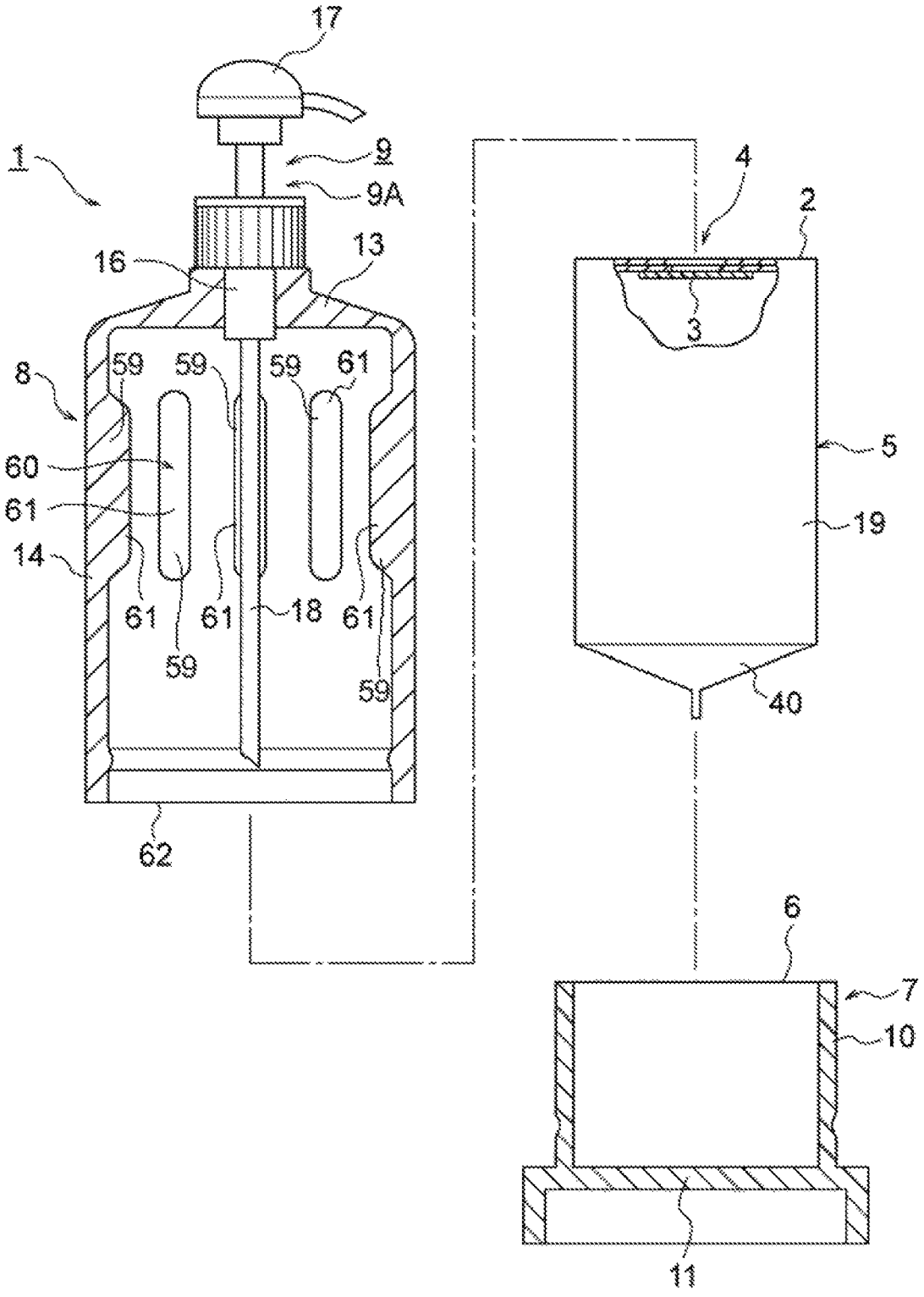
FIG. 22 is an exploded sectional view for illustrating a fourth example of the refillable container according to the embodiment the present invention.
Figure 23:
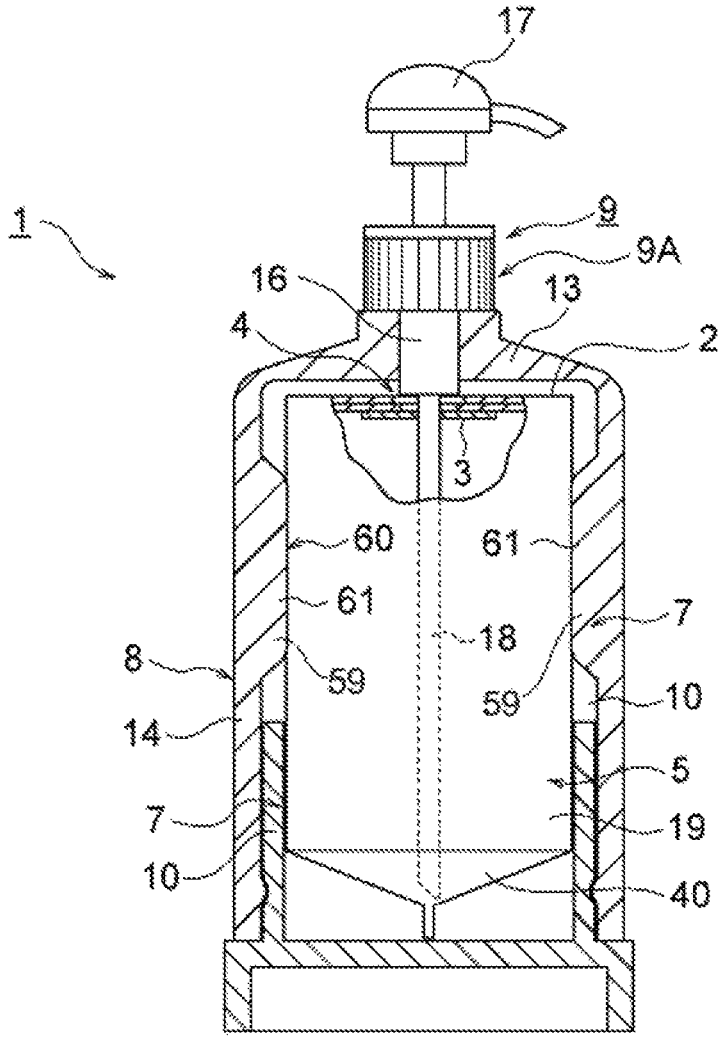
FIG. 23 is a sectional view for illustrating a state in which the accommodation member accommodating the inner container is closed by a lid member in the refillable container illustrated in FIG. 22.
Figure 24:
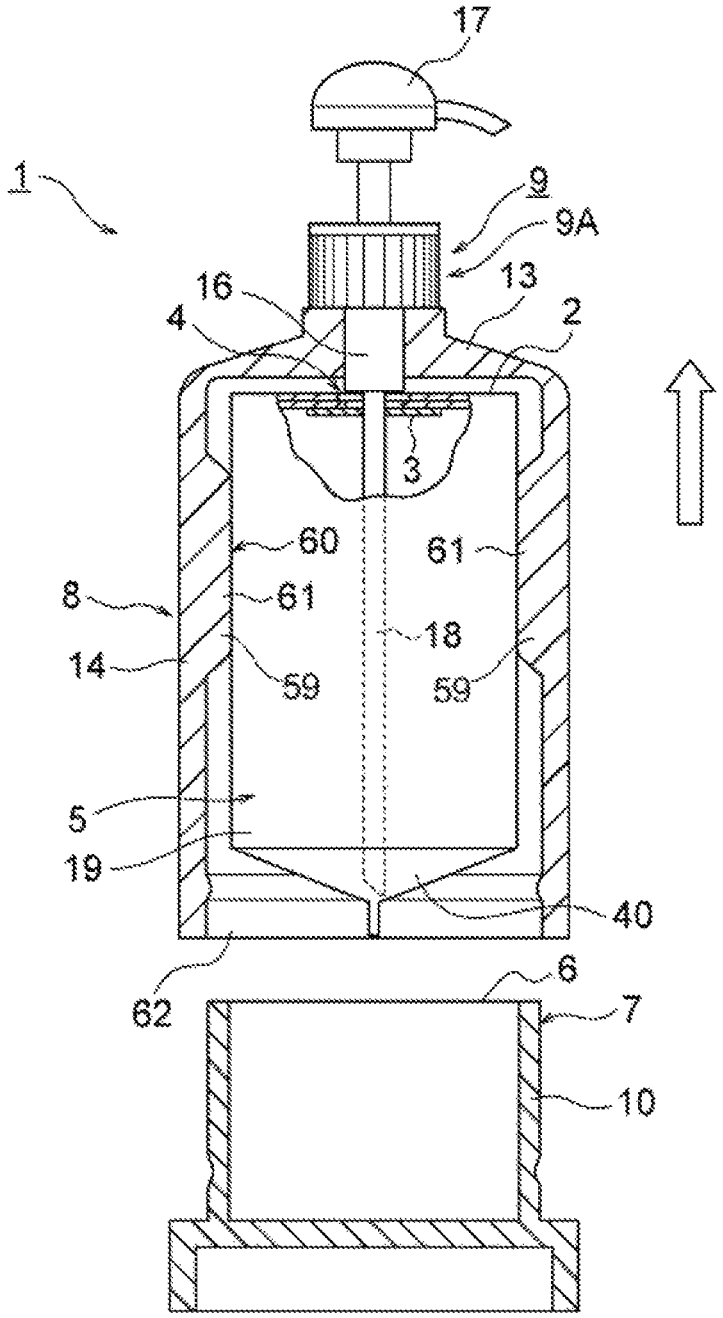
FIG. 24 is a sectional view for illustrating a state in which the lid member is removed from the accommodation member accommodating the inner container in the refillable container illustrated in FIG. 22.
Figure 25:
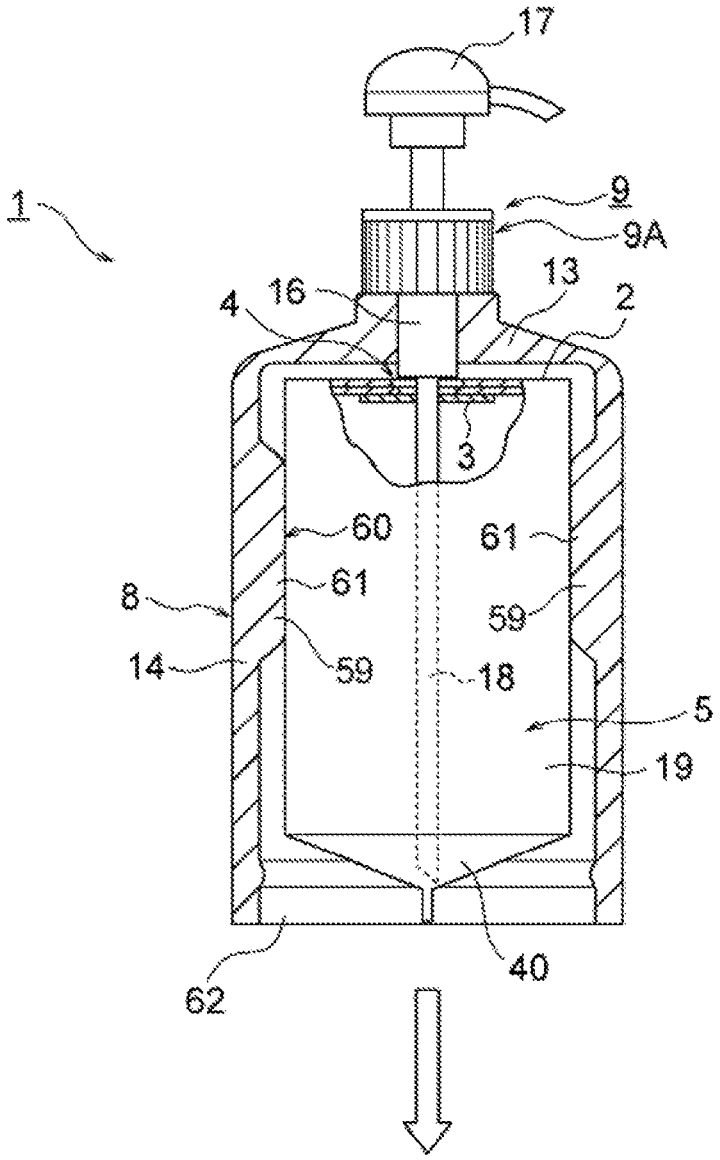
FIG. 25 is a sectional view for illustrating a state in which the inner container accommodated in the lid member, which has been removed from the accommodation member, is taken out from the lid member in the refillable container illustrated in FIG. 22.
Figure 26:
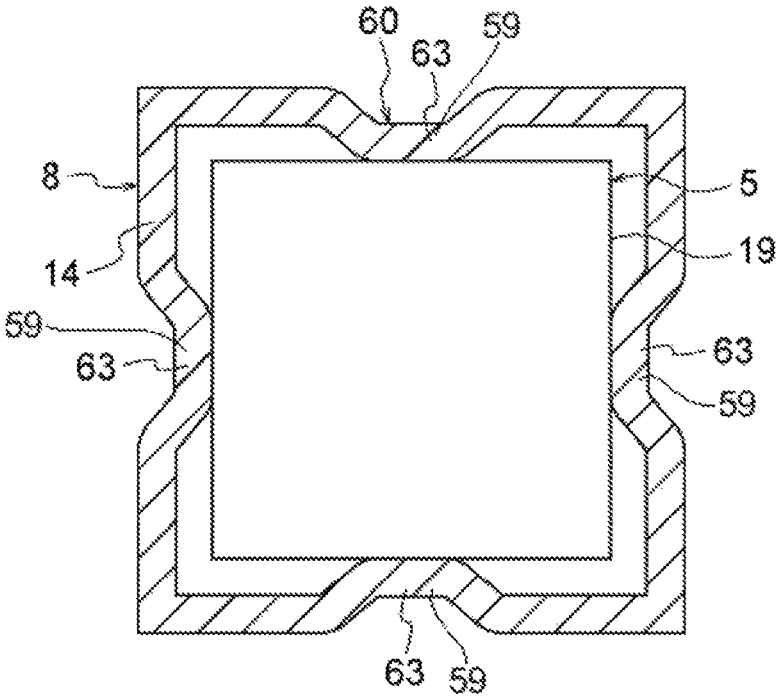
FIG. 26 is a schematic transverse sectional view for illustrating another example of a contact portion provided in the lid member in the refillable container of the fourth example.
Figure 27:
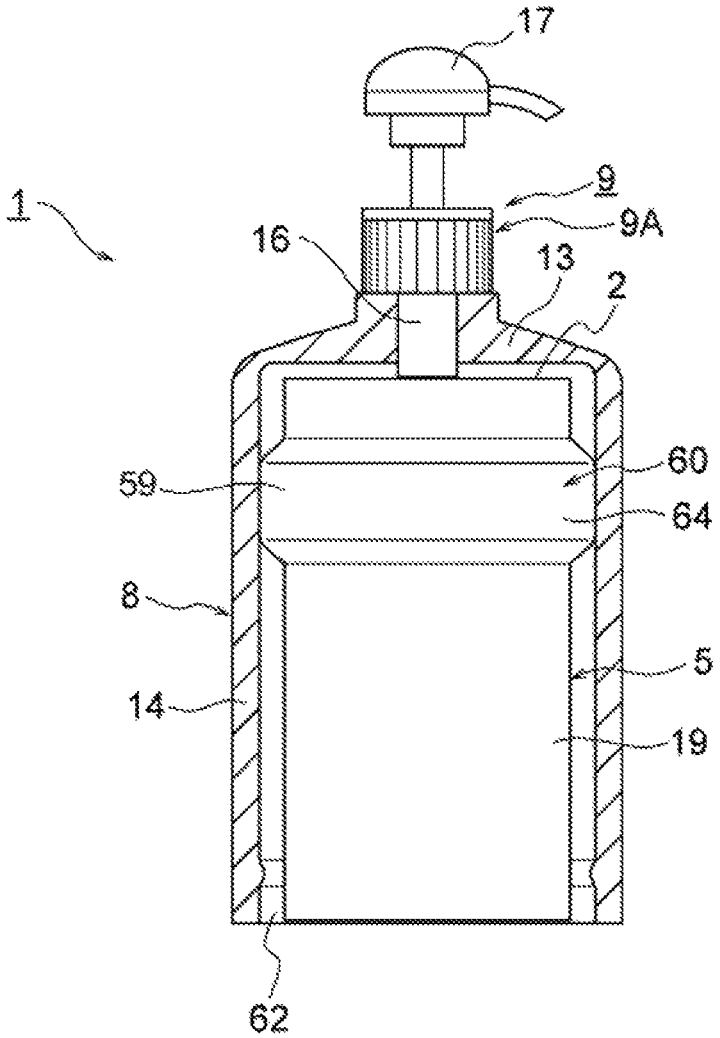
FIG. 27 is a sectional view for illustrating an example of a contact portion provided in the inner container in the refillable container of the fourth example.
Figure 28:
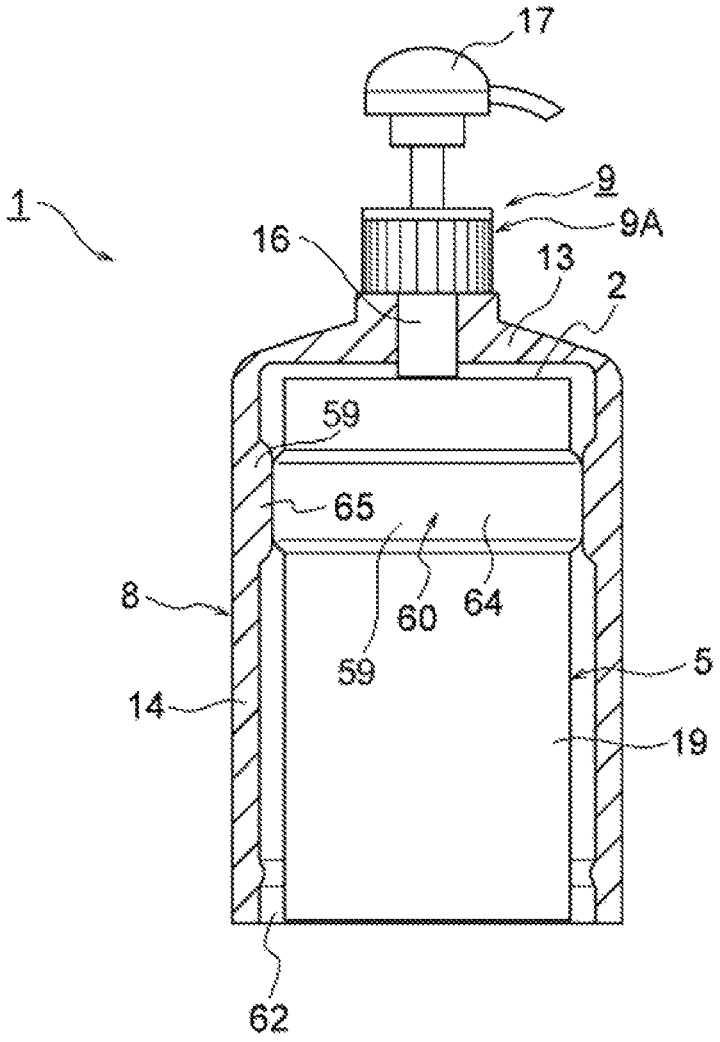
FIG. 28 is a sectional view for illustrating an example of the contact portion provided in the lid member and the inner container in the refillable container of the fourth example.
Figure 29:
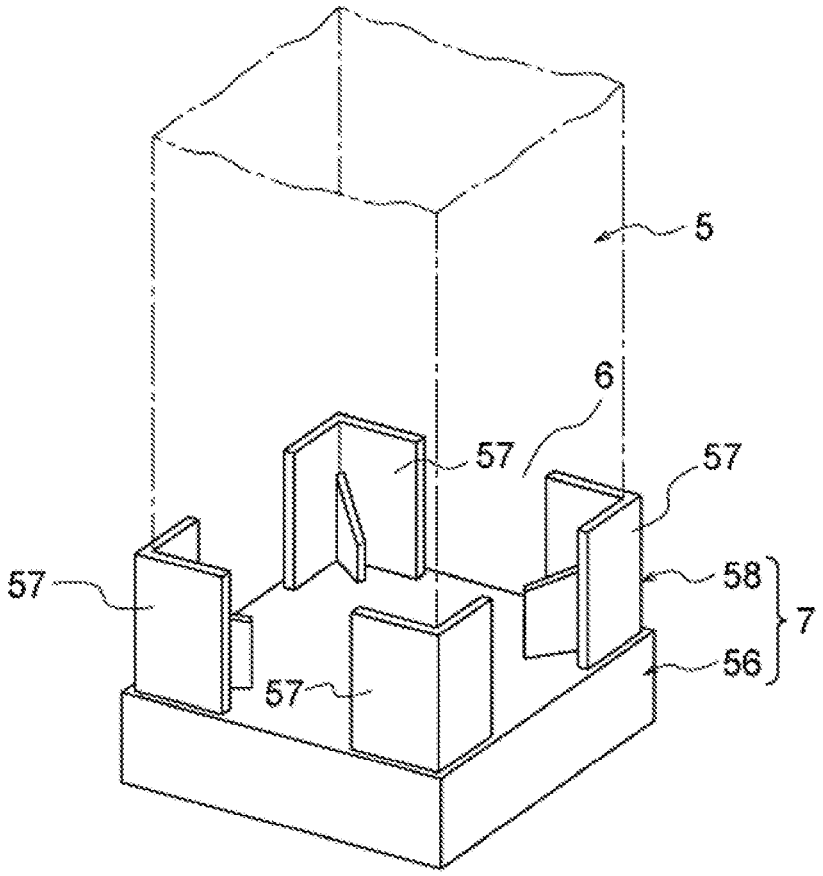
FIG. 29 is a perspective view for illustrating another example of the accommodation member in the refillable container of the fourth example.

FIG. 22 to FIG. 29 are views for illustrating a fourth example of the refillable container according to the embodiment of the present invention. FIG. 22 is an exploded sectional view of the refillable container of the fourth example. FIG. 23 is a sectional view for illustrating a state in which the accommodation member accommodating the inner container is closed by the lid member in the refillable container illustrated in FIG. 22. FIG. 24 is a sectional view for illustrating a state in which the lid member is removed from the accommodation member accommodating the inner container in the refillable container illustrated in FIG. 22. FIG. 25 is a sectional view for illustrating a state in which the inner container accommodated in the lid member which has been removed from the accommodation member is taken out from the lid member in the refillable container illustrated in FIG. 22. FIG. 26 is a schematic transverse sectional view for illustrating another example of a contact portion provided in the lid member in the refillable container of the fourth example. FIG. 27 is a sectional view for illustrating one example of the contact portion provided in the inner container in the refillable container of the fourth example. FIG. 28 is a sectional view for illustrating one example of the contact portion provided in the lid member and the inner container in the refillable container of the fourth example. FIG. 29 is a perspective view for illustrating another example of the accommodation member in the refillable container of the fourth example.

The refillable container 1 of the fourth example is not different from the refillable container 1 of the first example in a basic configuration, and the same configurations as those of the first example are denoted with the same reference symbols for description.

The fourth example is different from the first example in the inner-container restraint part 59 to restrain the lid member 8 and the inner container 5, and other configurations are the same as those in the first example.

In the fourth example, the inner-container restraint part 59 is provided on one or both of the inner surface of the cylindrical wall portion 14 of the lid member 8 and the outer surface of the body 19 of the inner container 5, and is formed of a contact portion 60 configured to make the inner wall of the cylindrical wall portion 14 come into contact with the outer surface of the body 19 of the inner container 5. The lid member 8 and the inner container 5 are restrained by a resistance force of the contact portion 60.

Accordingly, when the inner container 5 is accommodated in the accommodation container 10, a length of the accommodation container 10 is set to a length with which the inner container 5 at least protrudes from the accommodation opening 6 of the accommodation container 10, and the outer surface of the body 19 of the inner container 5 faces the inner surface of the lid member 8 which closes the accommodation member 7 outside the accommodation container 10.

In the fourth example, the contact portion 60 serving as the inner-container restraint part 59 is provided on the inner surface of the cylindrical wall portion 14 of the lid member 8. The contact portion 60 provided on the inner surface of the cylindrical wall portion 14 of the lid member 8 is, in the fourth example, formed by a plurality of ribs 61 extending in a longitudinal direction. The height of the ribs 61 is set to a height at which the ribs 61 come into contact with the outer surface of the body 19 of the inner container 5 with a predetermined pressing force.

The resistance force of the contact portion 60 provided on the inner surface of the cylindrical wall portion 14 of the lid member 8 which comes into contact with the outer surface of the body 19 of the inner container 5 is as follows.

The resistance force of the contact portion 60 at the time of pulling out the inner container 5 accommodated in the lid member 8 from the opening portion 62 of the lid member 8 is represented by X1, a lower limit resistance force to prevent the inner container 5 from falling from the opening portion of the lid member by its own weight is represented by X2, and an upper limit resistance force capable of pulling out the inner container 5 accommodated in the lid member 8 from the opening portion 62 of the lid member 8 in a state in which the content contained in the inner container 5 accommodated in the lid member 8 has been exhausted is represented by X3. In this case, the resistance force X1 given at the time of pulling out the inner container 5 accommodated in the lid member 8 from the opening portion 62 of the lid member 8 is set within a range defined by $X2 \leq X1 \leq X3$.

The lower limit resistance force X2 may be calculated with the inner container 5 in a state in which the content has been exhausted, or with the inner container 5 in a state in which the content is fully contained.

Further, the upper limit resistance force X3 is preferably calculated as a resistance force capable of pulling out the inner container 5 from the opening portion 62 of the lid member 8 without difficulty in a state in which the content contained in the inner container 5 accommodated in the lid member 8 has been exhausted. The resistance force capable of pulling out without difficulty refers to a resistance force which allows an adult to hold and easily pull out the inner container 5 accommodated in the lid member 8 without particularly being conscious of a strong force.

The upper limit resistance force X3 was calculated as follows.

<Evaluation of Resistance X>

With changes in height of the ribs 61 serving as the contact portion 60 provided on the inner surface of the cylindrical wall portion 14 of the lid member 8, the resistance force at the time of pulling out the inner container 5 from the opening portion 62 of the lid member 8 was changed, and resistance feeling at the time of pulling out was evaluated by sensory. Further, the resistance force at that time was measured using a push-pull gauge.

Sensory Evaluation Criteria

◎ very easily pulled out

○ pulled out without difficulty

Δ pulled out but strong resistance

× cannot be pulled out

Evaluation results are shown in Table 1.

TABLE 1

| Sensory evaluation | ◎ | ○ | Δ | X |
|---|---|---|---|---|
| Resistance force (kgf) | 1.2 | 1.5 | 1.7 | 2.2 |

From the above results, the upper limit resistance force X3 capable of pulling out without difficulty is calculated as follows.

Upper Limit Resistance Force X3=1.5 kgf

The resistance force X1, the lower limit resistance force X2, and the upper limit resistance force X3 are controlled by controlling mutual pressing forces of the cylindrical wall portion 14 of the lid member 8 and of the body 19 of the inner container 5 at the contact portion 60, and a friction coefficient at the contact portion 60.

In this example, the contact portion 60 is formed by the ribs 61, but is not limited thereto. For example, protrusions (not shown) formed by embossing may be formed on the inner surface of the cylindrical wall portion 14 of the lid member 8 to form the contact portion 60, or as illustrated in FIG. 26, portions of the cylindrical wall portion 14 of the lid member 8 may be concavely bent to form recessed curve portions 63, and the recessed curve portions 63 may be used as the contact portion 60. The pressing force at the contact portion 60 is controlled by the height, shape, contact area, or the like of the ribs 61, the embossed portions, or the recessed curve portions 63 or the like.

The friction coefficient at the contact portion 60 is controlled by processing a surface of the inner surface of the cylindrical wall portion 14 of the lid member 8 (for example, mat, mirror, etc.), applying an anti-slip agent or the like, or providing a rubber layer, a silicon layer, or the like.

In the refillable container 1 configured as described above, the operation of refilling the liquid content is performed as described below.

The operation of refilling the liquid content contained in the refillable container 1 includes an accommodation operation and a taking-out operation. In the accommodation operation, the inner container 5 is accommodated in the accommodation container 10 serving as the accommodation member 7 in the refillable container 1. In the taking-out operation, the inner container 5 accommodated in the accommodation container 10 is taken out from the accommodation container 10.

In the accommodation operation of the inner container 5 in the accommodation container 10, first, the inner container 5 is accommodated in the accommodation container 10.

Next, the cylindrical wall portion 14 of the lid member 8 is fitted to the outer periphery of the accommodation container 10 accommodating the inner container 5 to close the accommodation opening 6 of the accommodation container 10. In this example, in the process of closing the accommodation opening 6 of the accommodation container 10, the ribs 61 serving as the contact portion 60 provided on the inner surface of the cylindrical wall portion 14 of the lid member 8 move in a closing direction while coming into contact with the outer surface of the body 19 of the inner container 5.

Further, in the process of closing the accommodation opening 6 of the accommodation container 10, the suction tube 18 arranged on the lower surface side of the top plate portion 13 of the lid member 8 tears the sealing sheet 3 arranged on the upper surface 2 of the inner container 5 accommodated in the accommodation container 10 to be inserted from the suction port 4 into the inner container 5.

In this way, the accommodation opening 6 of the accommodation container 10 is closed by the lid member 8, and the accommodation operation of the inner container 5 into the accommodation container 10 is completed. At this time, the outer surface of the body 19 of the inner container 5 accommodated in the accommodation container 10 is in contact with the ribs 61 serving as the contact portion 60 which is provided on the inner surface of the cylindrical wall portion 14 of the lid member 8 (see FIG. 23).

When the liquid content contained in the inner container 5 accommodated in the accommodation container 10 has been exhausted, the lid member 8 is removed from the accommodation container 10, and the inner container 5 in which the content has been exhausted is taken out from the accommodation container 10.

In the taking-out operation of taking out the inner container 5 from this accommodation container 10, the lid member 8 is pulled up.

At this time, the resistance force of the contact portion 60 provided on the inner surface of the cylindrical wall portion 14 of the lid member 8 which comes into contact with the outer surface of the body 19 of the inner container 5 is such that: in the case in which the resistance force of the contact portion 60 at the time of pulling out the inner container 5 accommodated in the lid member 8 from the opening portion 62 of the lid member 8 is represented by X1, the lower limit resistance force to prevent the inner content 5 from falling from the opening portion of the lid member by its own weight is represented by X2, and the upper limit resistance force capable of pulling out the inner container 5 accommodated in the lid member 8 from the opening portion 8 of the lid member 8 in a state in which the content has been exhausted is represented by X3, the resistance force X1 given at the time of pulling out the inner container 5 accommodated in the lid member 8 from the opening portion 62 of the lid member 8 is set within the range of $X2 \leq X1 \leq X3$. Therefore, when the lid member 8 is removed from the accommodation container 10 accommodating the inner container 5, the inner container 5 accommodated in the lid member 8 is taken out from the accommodation container 10 integrally with the lid member 8, and the inner container 5 is prevented from falling from the lid member 8 even when the opening portion 62 of the lid member 8 is oriented downward (see FIG. 24).

Then, taking out the inner container 5 from the lid member 8 can be performed, with the condition of $X1 \leq X3$, by holding the inner container 5 exposed from the opening portion 62 of the lid member 8 to pull out reliably from the opening portion 62 of the lid member 8 (see FIG. 25).

In this way, the taking-out operation of the inner container 5 accommodated in the accommodation container 10 is completed.

Note that, in a case in which the lower limit resistance force X2 is calculated with the inner container 5 in which the content has been exhausted, when the lid member 8 is removed from the accommodation container 10 after the content has been exhausted, the inner container 5 accommodated in the lid member 8 can be reliably taken out from the accommodation container 10 integrally with the lid member 8.

Further, in a case in which the lower limit resistance force X2 is calculated with the inner container 5 in a state in which the content is fully contained, when the lid member 8 is removed from the accommodation container 10 in the state in which the content is fully contained in the inner container 5, the inner container 5 accommodated in the lid member 8 can be reliably taken out from the accommodation container 10 integrally with the lid member 8.

Still further, when the upper limit resistance force X3 is calculated as a resistance force capable of pulling out the inner container 5 from the opening portion 62 of the lid member 8 without difficulty in a state in which the content contained in the inner container 5 accommodated in the lid member 8 has been exhausted, the inner container 5 in which the content has been exhausted can be easily and reliably pulled out from the opening portion 62 of the lid member 8.

Note that, in the fourth example, the contact portion 60 at which the inner surface of the cylindrical wall portion 14 of the lid member 8 comes in contact with the outer surface of the inner container 5 accommodated in the lid member 8 is formed with the contact portion 60 on the inner surface of the cylindrical wall portion 14 of the lid member 8. However, as illustrated in FIG. 27, the contact portion 60 may be formed by forming an annular protruding portion 64 around the outer surface of the body 19 of the inner container 5, or, as illustrated in FIG. 28, the contact portion 60 may be formed by forming the annular protruding portion 64 around the outer surface of the body 19 of the inner container 5, and forming an annular protruding portion 65 which comes into contact with the annular protruding portion 64 around the inner surface of the cylindrical wall portion 14 of the lid member 8.

Further, the contact portion 60 at which the inner surface of the cylindrical wall portion 14 of the lid member 8 comes into contact with the outer surface of the inner container 5 accommodated in the lid member 8 is not always required to be formed by the protrusions such as the ribs 61 formed on the inner surface of the cylindrical wall portion 14 of the lid member 8, the annular protruding portion 64 formed around the outer surface of the body 19 of the inner container 5, and the annular protruding portion 64 formed around the outer surface of the body 19 of the inner container 5 and the annular protruding portion 65 formed around the inner surface of the cylindrical wall portion 14 of the lid member 8. Although not illustrated, the inner surface of the cylindrical wall portion 14 of the lid member 8 comes into contact with the outer surface of the container 5 to form the contact portion 60, and the resistance force of the resistance force X1, the lower limit resistance force X2, and the upper limit resistance force X3 may be controlled by controlling the friction coefficient only by the materials of the cylindrical wall portion 14 of the lid member 8 and the inner container 5.

Still further, in the fourth example, the accommodation member 7 is a cylindrical accommodation container 10 having the accommodation opening 6 at the upper portion, but is not limited thereto. As illustrated in FIG. 29, the accommodation member 7 may be formed by, as the accommodation member 7 of the third example, the support base portion 56 and the support frame portion 58 which is formed vertically by a plurality of support pieces 57 at intervals along the outer surface of the body 19 of the inner container 5 on the upper surface of the support base portion 56 to configure in a pedestal shape in which the inner container 5 is accommodated inside the support frame portion 58.

In the fourth example, the accommodation opening 6 through which the inner container 5 is accommodated in the accommodation member 7 is open at the upper portion, but is not limited to this, and may be open at a side.

Further, in the fourth example, the inner container 5 is formed of a paper material, but is not limited thereto, and may be formed of a resin material. The shape of the body 19 is not limited to a rectangular cylindrical shape and may be formed in a cylindrical shape.

Further, in the fourth example, the taking-out part 9 is mounted to the lid member 8 to be integrated with the lid member 8, but is not always required to be mounted to the lid member 8.

REFERENCE SIGNS LIST

1 refillable container
2 upper surface
3 sealing sheet
4 suction port
5 inner container
6 accommodation opening
7 accommodation member
8 lid member
9 taking-out part
9A discharge pump
10 accommodation container
11 bottom portion
12 cutout portion
13 top plate portion
14 cylindrical wall portion
15 protruding portion
16 tubular cylinder portion
17 discharge nozzle
18 suction tube
19 body
20 protruding step portion
21, 22, 23 body longitudinal folding line
24, 25, 26, 27 body panel
28 seal longitudinal folding line
29 longitudinal seal panel
30, 31 top horizontal folding line
32, 33 upper-surface forming panel
34 sealing panel
35, 36 side panel
37, 38 top horizontal folding line
39*a*, 39*b* hole
40 bottom surface
41, 42 bottom horizontal folding line
43, 44 gable roof-shaped bottom surface forming panel
45, 46 outer sealing panel
47, 48 bottom horizontal folding line
49, 50 gable wall-shaped bottom surface forming panel
51, 52 inner sealing panel
53 top plate
54 hole
55 bottom plate
56 support base portion
57 support piece
58 support frame portion
59 inner-container restraint part
60 contact portion
61 rib
62 opening portion
63 concavely curved
64, 65 annular protruding portion

The invention claimed is:

1. A refillable container, comprising:

an inner container configured to contain a content and be replaced when the content has been exhausted;

an accommodation member, which has an accommodation opening, and is configured to accommodate the inner container;

a cylindrical lid member, which is to be fitted to the accommodation member accommodating the inner container, and is configured to close the accommodation member;

a taking-out part configured to take out the content contained in the inner container accommodated in the accommodation member; and an inner-container restraint part, which is provided between the lid member and the inner container, is configured to restrain the lid member and the inner container so as to prevent the inner container from falling from an opening portion of the lid member by its own weight when the lid member is removed from the accommodation member, and is configured to release the restraint between the lid member and the inner container when the inner container in which the content has been exhausted is pulled from the opening portion of the lid member in a pull-out direction.

2. The refillable container according to claim 1, wherein the inner-container restraint part includes:

a protruding step portion provided on an upper outer surface of a body of the inner container; and a protruding portion provided on an inner surface of a cylindrical wall portion which is fitted to an outer periphery of the accommodation member of the lid member, wherein, at a time of an operation of closing the accommodation member with the lid member, the protruding portion rides over the protruding step portion provided on the upper outer surface of the inner container accommodated in the accommodation member, and wherein, at a time of an operation of removing the lid member from the accommodation member, the protruding portion engages with a lower side of the protruding step portion so as to restrain the inner container and prevent the inner container from falling from the opening portion of the lid member by its own weight, and the restraint is released by pulling the inner container from the opening portion of the lid member so that the protruding step portion rides over the protruding portion.

3. The refillable container according to claim 2, wherein the protruding step portion provided on the upper outer surface of the body of the inner container is provided at an upper end edge portion of the body.

4. The refillable container according to claim 2, wherein the protruding step portion provided on the upper outer surface of the body of the inner container is provided at an outer peripheral surface of the body.

5. The refillable container according to claim 1, wherein the inner-container restraint part is provided on one or both of an inner surface of a cylindrical wall portion of the lid member and an outer surface of a body of the inner container, and is formed of a contact portion configured to make the inner surface of the cylindrical wall portion of the lid member come into contact with the outer surface of the body of the inner container, and wherein a resistance force of the contact portion at a time of pulling out the inner container from the opening portion of the lid member is represented by X1, a lower limit resistance force to prevent the inner content from falling from the opening portion of the lid member by its own weight is represented by X2, and an upper limit resistance force capable of pulling out the inner container accommodated in the lid member from the opening portion of the lid member in a state in which the content has been exhausted is represented by X3, and the resistance force X1 given at the time of pulling out the inner container accommodated in the lid member from the opening portion of the lid member is set within a range defined by $X2 \leq X1 \leq X3$.

6. The refillable container according to claim 5, wherein the lower limit resistance force X2 is calculated with the inner container in a state in which the content has been exhausted.

7. The refillable container according to claim 5, wherein the lower limit resistance force X2 is calculated with the inner container in a state in which the content is fully contained.

8. The refillable container according to claim 5, wherein the upper limit resistance force X3 is calculated as a resistance force capable of pulling out the inner container from the opening portion of the lid member without difficulty in a state in which the content contained in the inner container accommodated in the lid member has been exhausted.

9. The refillable container according to claim 6, wherein the upper limit resistance force X3 is calculated as a resistance force capable of pulling out the inner container from the opening portion of the lid member without difficulty in a state in which the content contained in the inner container accommodated in the lid member has been exhausted.

10. The refillable container according to claim 7, wherein the upper limit resistance force X3 is calculated as a resistance force capable of pulling out the inner container from the opening portion of the lid member without difficulty in a state in which the content contained in the inner container accommodated in the lid member has been exhausted.

* * * * *